US011336031B2

(12) United States Patent
Wang et al.

(10) Patent No.: US 11,336,031 B2
(45) Date of Patent: May 17, 2022

(54) ANTENNA, ARRAY ANTENNA, SECTOR ANTENNA, AND DIPOLE ANTENNA

(71) Applicant: NIHON DENGYO KOSAKU CO.,LTD., Tokyo (JP)

(72) Inventors: Lin Wang, Tokyo (JP); Tomoyuki Soga, Tokyo (JP)

(73) Assignee: NIHON DENGYO KOSAKU CO., LTD., Tokyo (JP)

( * ) Notice: Subject to any disclaimer, the term of this patent is extended or adjusted under 35 U.S.C. 154(b) by 249 days.

(21) Appl. No.: 16/613,798

(22) PCT Filed: May 16, 2017

(86) PCT No.: PCT/JP2017/018398
§ 371 (c)(1),
(2) Date: Nov. 15, 2019

(87) PCT Pub. No.: WO2018/211597
PCT Pub. Date: Nov. 22, 2018

(65) Prior Publication Data

US 2020/0176892 A1 Jun. 4, 2020

(51) Int. Cl.
*H01Q 21/26* (2006.01)
*H01Q 9/16* (2006.01)
*H01Q 15/14* (2006.01)

(52) U.S. Cl.
CPC ..... *H01Q 21/26* (2013.01); *H01Q 9/16* (2013.01); *H01Q 15/14* (2013.01)

(58) Field of Classification Search
CPC ..... H01Q 5/48; H01Q 9/065; H01Q 9/16; H01Q 15/14; H01Q 21/26; H01Q 21/30
See application file for complete search history.

(56) References Cited

U.S. PATENT DOCUMENTS 6,008,773 A 12/1999 Matsuoka et al.
6,542,131 B1 4/2003 Haapanen
(Continued)

FOREIGN PATENT DOCUMENTS

CN 2676433 2/2005
CN 103647138 3/2014
(Continued)

OTHER PUBLICATIONS

"International Search Report (Form PCT/ISA/210) of PCT/JP2017/018398," dated Aug. 1, 2017, with English translation thereof, pp. 1-7.

*Primary Examiner* — Hasan Islam
(74) *Attorney, Agent, or Firm* — JCIPRNET

(57) ABSTRACT

The antenna includes: a reflective member including a flat part; a first antenna element disposed on the flat part of the reflective member, the first antenna element being configured to transmit and receive radio waves of a first polarization; a second antenna element disposed on the flat part of the reflective member, one end of the second antenna element being located close to one end of the first antenna element, the second antenna element being configured to transmit and receive radio waves of a second polarization different from the first polarization; and a conductive member disposed close to the one ends of the first antenna element and the second antenna element and near a point of intersection where the first antenna element and the second antenna element meet when extended.

11 Claims, 9 Drawing Sheets

(56) References Cited

U.S. PATENT DOCUMENTS

| | | | | |
|---|---|---|---|---|
| 6,650,301 | B1 | 11/2003 | Zimmerman | |
| 6,734,829 | B1 | 5/2004 | Goettl | |
| 2002/0021257 | A1 | 2/2002 | Zimmerman | |
| 2011/0175782 | A1 | 7/2011 | Choi et al. | |
| 2013/0307743 | A1* | 11/2013 | Moon | H01Q 21/08 343/833 |
| 2014/0327591 | A1 | 11/2014 | Kokkinos | |
| 2015/0102971 | A1* | 4/2015 | Liu | H01Q 21/24 343/798 |
| 2015/0222025 | A1 | 8/2015 | Song et al. | |
| 2015/0263435 | A1 | 9/2015 | Song et al. | |
| 2016/0006128 | A1 | 1/2016 | Yamamoto et al. | |
| 2016/0248166 | A1 | 8/2016 | Moon et al. | |
| 2019/0020124 | A1 | 1/2019 | Song et al. | |
| 2020/0014097 | A1* | 1/2020 | Kim | H01Q 15/14 |
| 2020/0067205 | A1* | 2/2020 | Segador Alvarez | H01Q 5/307 |

FOREIGN PATENT DOCUMENTS

| | | |
|---|---|---|
| CN | 103947041 | 7/2014 |
| CN | 206116609 | 4/2017 |
| JP | H10150319 | 6/1998 |
| JP | 2002026629 | 1/2002 |
| JP | 2002111358 | 4/2002 |
| JP | 2002538648 | 11/2002 |
| JP | 2003504925 | 2/2003 |
| JP | 2004023797 | 1/2004 |
| JP | 2009200776 | 9/2009 |
| JP | 2012503405 | 2/2012 |
| JP | 2015033018 | 2/2015 |
| JP | 2015507382 | 3/2015 |
| JP | 2016534598 | 11/2016 |
| JP | 2017505075 | 2/2017 |
| WO | 2010033004 | 7/2010 |
| WO | 2014136543 | 9/2014 |
| WO | 2015029946 | 3/2015 |

* cited by examiner (a)

(b)

ANTENNA, ARRAY ANTENNA, SECTOR ANTENNA, AND DIPOLE ANTENNA

CROSS-REFERENCE TO RELATED APPLICATION

This application is a 371 application of the international PCT application serial no. PCT/JP2017/018398, filed on May 16, 2017. The entirety of the abovementioned patent applications is hereby incorporated by reference herein and made a part of this specification.

TECHNICAL FIELD

The present invention relates to an antenna, an array antenna, a sector antenna, and a dipole antenna.

BACKGROUND ART

A mobile communication base station antenna is comprised of a combination of multiple sector antennas radiating radio waves in respective sectors (areas) each of which is set according to a direction in which the radio waves are radiated. As the sector antenna, an array antenna is used that includes radiation elements (antenna elements), such as dipole antennas, arranged in an array.

Patent Document 1 discloses a wideband polarized antenna that includes a reflector and a separation member. The reflector is provided with two or four slits for improving separation characteristics by 2 dB to 6 dB. The separation member improves separation characteristics of the array antenna.

CITATION LIST

Patent Literature

Patent Document 1: Chinese Patent Application Publication No. 103647138

SUMMARY OF INVENTION

Technical Problem

For improved communication quality and increased communication capacity, the array antenna may use dual polarization antennas that are capable of transmitting and receiving radio waves of mutually different polarizations. It is required that the amount of polarization coupling between antenna elements transmitting and receiving radio waves of respective polarizations be kept low over a wide band.

An object of the present invention is to provide a dual polarization antenna and the like that can reduce the amount of polarization coupling between antenna elements transmitting and receiving radio waves of mutually different polarizations.

Solution to Problem

With this object in view, the antenna according to an aspect of the present invention includes: a reflective member including a flat part; a first antenna element disposed on the flat part of the reflective member, the first antenna element being configured to transmit and receive radio waves of a first polarization; a second antenna element disposed on the flat part of the reflective member, one end of the second antenna element being located close to one end of the first antenna element, the second antenna element being configured to transmit and receive radio waves of a second polarization different from the first polarization; and a conductive member disposed close to the one ends of the first antenna element and the second antenna element and near a point of intersection where the first antenna element and the second antenna element meet when extended, wherein each of the first antenna element and the second antenna element is a dipole antenna comprising: two radiation parts; a support part extending to the flat part of the reflective member, the support part being configured to support the two radiation parts; and a base configured to hold the support part relative to the flat part of the reflective member, wherein each of the two radiation parts includes a first portion, a second portion, and a third portion, the first portion being parallel to the flat part of the reflective member, the second portion changing distance from the flat part as the second portion goes away from the support part, the third portion bending and extending from a distal end of the second portion.

The above antenna may include: a third antenna element disposed on the flat part of the reflective member, the third antenna element being configured to transmit and receive radio waves of the first polarization; a fourth antenna element disposed on the flat part of the reflective member, one end of the fourth antenna element being located close to one end of the third antenna element, the fourth antenna element being configured to transmit and receive radio waves of the second polarization; and another conductive member disposed close to the one ends of the third antenna element and the fourth antenna element and near a point of intersection where the third antenna element and the fourth antenna element meet when extended, wherein the other end of the fourth antenna element is located close to the other end of the first antenna element, and the other end of the third antenna element is located close to the other end of the second antenna element, wherein each of the third antenna element and the fourth antenna element is a dipole antenna comprising: two radiation parts; a support part extending to the flat part of the reflective member, the support part being configured to support the two radiation parts; and a base configured to hold the support part relative to the flat part of the reflective member, wherein each of the two radiation parts includes a first portion, a second portion, and a third portion, the first portion being parallel to the flat part of the reflective member, the second portion changing distance from the flat part as the second portion goes away from the support part, the third portion bending and extending from a distal end of the second portion.

This can increase the symmetry of the directivity in the horizontal direction and in the vertical direction.

Further, each of the conductive member and the another conductive member may be a rod-like or plate-like member rising from the flat part of the reflective member, and each of the conductive member and the another conductive member may be directly connected to the reflective member at one position.

This can reduce occurrence of intermodulation distortion and white noise.

The above antenna may include: a third antenna element disposed on the flat part of the reflective member, one end of the third antenna element being located close to the one end of the first antenna element, the third antenna element being configured to transmit and receive radio waves of the first polarization; and a fourth antenna element disposed on the flat part of the reflective member, one end of the fourth antenna element being located close to the one end of the first antenna element, the fourth antenna element being configured to transmit and receive radio waves of the second polarization, wherein the conductive member is disposed close to the one ends of the third antenna element and the fourth antenna element and near a point of intersection where the third antenna element and the fourth antenna element meet when extended, wherein each of the third antenna element and the fourth antenna element is a dipole antenna comprising: two radiation parts; a support part extending to the flat part of the reflective member, the support part being configured to support the two radiation parts; and a base configured to hold the support part relative to the flat part of the reflective member, wherein each of the two radiation parts includes a first portion, a second portion, and a third portion, the first portion being parallel to the flat part of the reflective member, the second portion changing distance from the flat part as the second portion goes away from the support part, the third portion bending and extending from a distal end of the second portion.

This can increase the symmetry of the directivity in the horizontal direction and in the vertical direction.

Also, the conductive member may be a rod-like or plate-like rising from the flat part of the reflective member, and the conductive member may be directly connected to the reflective member at one point.

This can reduce occurrence of intermodulation distortion and white noise.

The array antenna according to another aspect of the present invention includes: a reflective member including a flat part; a plurality of first antennas arranged on the flat part of the reflective member, each of the plurality of first antennas including a first antenna element, a second antenna element, a third antenna element, a fourth antenna element, a first conductive member, and a second conductive member, the first antenna element being configured to transmit and receive radio waves of a first polarization in a first frequency band, the second antenna element being configured to transmit and receive radio waves of a second polarization in the first frequency band different from the first polarization in the first frequency band, one end of the second antenna element being located close to one end of the first antenna element, the third antenna element being configured to transmit and receive radio waves of the first polarization in the first frequency band, the fourth antenna element being configured to transmit and receive radio waves of the second polarization in the first frequency band, one end of the fourth antenna element being located close to one end of the third antenna element, the first conductive member being disposed close to the one ends of the first antenna element and the second antenna element and near a point of intersection where the first antenna element and the second antenna element meet when extended, the second conductive member being disposed close to the one ends of the third antenna element and the fourth antenna element and near a point of intersection where the third antenna element and the fourth antenna element meet when extended, the other end of the first antenna element being located close to the other end of the fourth antenna element, the other end of the second antenna element being located close to the other end of the third antenna element; and a plurality of second antennas arranged on the flat part of the reflective member along an array of the plurality of first antennas, each of the plurality of second antennas being configured to transmit and receive radio waves in a second frequency band higher than the first frequency band, wherein each of the first antenna element, the second antenna element, the third antenna element, and the fourth antenna element included in each of the plurality of first antennas is a dipole antenna comprising: two radiation parts; a support part extending to the flat part of the reflective member, the support part being configured to support the two radiation parts; and a base configured to hold the support part relative to the flat part of the reflective member, wherein each of the two radiation parts includes a first portion, a second portion, and a third portion, the first portion being parallel to the flat part of the reflective member, the second portion changing distance from the flat part as the second portion goes away from the support part, the third portion bending and extending from a distal end of the second portion.

In this array antenna, an array of the plurality of second antennas may be arranged on the flat part of the reflective member such that the array of the plurality of second antennas overlaps the array of the plurality of first antennas.

This can reduce the size of the dual-frequency array antenna.

Also, an interval in the array of the plurality of first antennas may be three times an interval in the array of the plurality of the second antennas.

Further, two of the plurality of second antennas may be disposed in an area surrounded by the first antenna element, the second antenna element, the third antenna element, and the fourth antenna element of the first antennas.

This allows for efficient arrangement of the antennas.

The array antenna according to still another aspect of the present invention includes: a reflective member including a flat part; a plurality of first antennas arranged on the flat part of the reflective member, each of the plurality of first antennas including a first antenna element, a second antenna element, a third antenna element, a fourth antenna element, and a conductive member, the first antenna element being configured to transmit and receive radio waves of first polarization in a first frequency band, the second antenna element being configured to transmit and receive radio waves of second polarization in the first frequency band different from the first polarization, one end of the second antenna element being located close to one end of the first antenna element, the third antenna element being configured to transmit and receive radio waves of the first polarization in the first frequency band, one end of the third antenna element being located close to the one end of the first antenna element, the fourth antenna element being configured to transmit and receive radio waves of the second polarization in the first frequency band, one end of the fourth antenna element being located close to the one end of the first antenna element, the conductive member being disposed close to the one ends of the first antenna element, the second antenna element, the third antenna element, and the fourth antenna element and near a point of intersection where the first antenna element, the second antenna element, the third antenna element, and the fourth antenna element meet when extended; and a plurality of second antennas arranged on the flat part of the reflective member along an array of the plurality of first antennas, each of the plurality of second antennas being configured to transmit and receive radio waves in a second frequency band higher than the first frequency band, wherein each of the first antenna element, the second antenna element, the third antenna element, and the fourth antenna element included in each of the plurality of first antennas is a dipole antenna comprising: two radiation parts; a support part extending to the flat part of the reflective member, the support part being configured to support the two radiation parts; and a base configured to hold the support part relative to the flat part of the reflective member, wherein each of the two radiation parts includes a first portion, a second portion, and a third portion, the first portion being parallel to the flat part of the reflective member, the second portion changing distance from the flat part as the second portion goes away from the support part, the third portion bending and extending from a distal end of the second portion.

In this array antenna, radio waves transmitted and received by the plurality of first antennas may include radio waves of +45 degree polarization and −45 degree polarization relative to an array of the plurality of first antennas.

This can further reduce the amount of polarization coupling.

The sector antenna according to still another aspect of the present invention includes: an array antenna including a plurality of antennas arranged on a flat part of a reflective member, each of the plurality of antennas including a first antenna element, a second antenna element, and a conductive member, the first antenna element being configured to transmit and receive radio waves of a first polarization, the second antenna element being configured to transmit and receive radio waves of a second polarization different from the first polarization, one end of the second antenna element being located close to one end of the first antenna element, the conductive member being disposed close to the one ends of the first antenna element and the second antenna element and near a point of intersection where the first antenna element and the second antenna element meet when extended; and a cover configured to cover the array antenna, wherein each of the first antenna element and the second antenna element is a dipole antenna comprising: two radiation parts; a support part extending to the flat part of the reflective member, the support part being configured to support the two radiation parts; and a base configured to hold the support part relative to the flat part of the reflective member, wherein each of the two radiation parts includes a first portion, a second portion, and a third portion, the first portion being parallel to the flat part of the reflective member, the second portion changing distance from the flat part as the second portion goes away from the support part, the third portion bending and extending from a distal end of the second portion.

The dipole antenna according to still another aspect of the present invention includes: two radiation parts; a support part extending to a flat part of a reflective member to which the support part is attached, the support part being configured to support the two radiation parts; and a base configured to hold the support part relative to the flat part of the reflective member, wherein each of the two radiation parts includes a first portion, a second portion, and a third portion, the first portion being parallel to the flat part of the reflective member, the second portion changing distance from the flat part as the second portion goes away from the support part, the third portion bending and extending from a distal end of the second portion.

This can shorten the length of the dipole antenna.

The above dipole antenna may include a spacer made of a dielectric and interposed between the base and the flat part of the reflective member, wherein the spacer includes a base holding member configured to hold the base.

This can improve efficiency in mounting the spacer.

The above dipole antenna may include a spacer made of a dielectric and interposed between the base and the flat part of the reflective member, wherein the spacer includes a spacer holding member configured to be held on the reflective member.

This can improve efficiency in fixing the dipole antenna to the reflector.

Advantageous Effects of Invention

The present invention can provide a dual polarization antenna and the like that can reduce the amount of polarization coupling between antenna elements transmitting and receiving radio waves of mutually different polarizations.

DESCRIPTION OF EMBODIMENTS

Embodiments of the present invention will be described in detail below with reference to the attached drawings.

First Embodiment

<Base Station Antenna 1>

Figure 1:
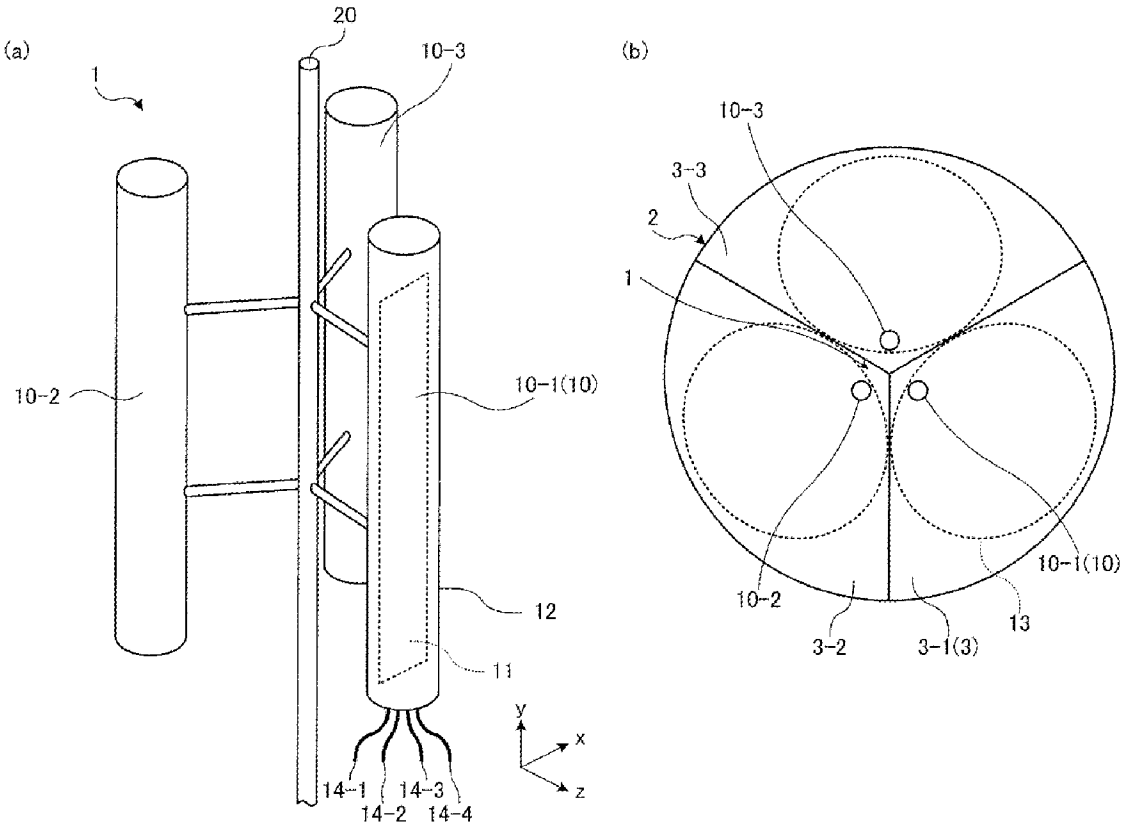
FIG. 1 shows an example of an entire configuration of a mobile communication base station antenna according to the first embodiment. (a) of FIG. 1 is a perspective view of the base station antenna, and (b) of FIG. 1 shows an installation example of the base station antenna.

FIG. 1 shows an example of an entire configuration of a mobile communication base station antenna 1 according to the first embodiment. (a) of FIG. 1 is a perspective view of the base station antenna 1, and (b) of FIG. 1 shows an installation example of the base station antenna 1.

As shown in (a) of FIG. 1, the base station antenna 1 includes, for example, multiple sector antennas 10-1 to 10-3 (hereinafter referred to as sector antennas 10 when they are not distinguished from each other) held by a tower 20. Each of the sector antennas 10-1 to 10-3 include an array antenna 11. The array antenna 11 is covered with a radome 12, which is a cover to protect the array antenna 11 against weather. In other words, the exterior of each of the sector antennas 10-1 to 10-3 is the radome 12, and the array antenna 11 is installed inside the radome 12. The radome 12 shown in (a) of FIG. 1 is cylindrical, but the radome 12 may have any other shape. The base station antenna 1 transmits and receives radio waves within a cell 2 shown in (b) of FIG. 1.

As will be described below, each of the sector antennas 10 is a dual-frequency and dual-polarization antenna that transmits and receives radio waves of orthogonal polarizations in each of two different frequency bands. Here, the two different frequency bands are respectively referred to as a high frequency band and a low frequency band. The frequency designed in the high frequency band is defined as a frequency $f_{0H}$ (wavelength $\lambda_{0H}$), and the frequency designed in the low frequency band is defined as a frequency $f_{0L}$ (wavelength $\lambda_{0L}$). The wavelength $\lambda_{0H}$, $\lambda_{0L}$ is free-space wavelength. For example, the high frequency band is the 2 GHz band, and the low frequency band is the 800 MHz band.

The low frequency band is an example of the first frequency band, and the high frequency band is an example of the second frequency band.

Figure 2:
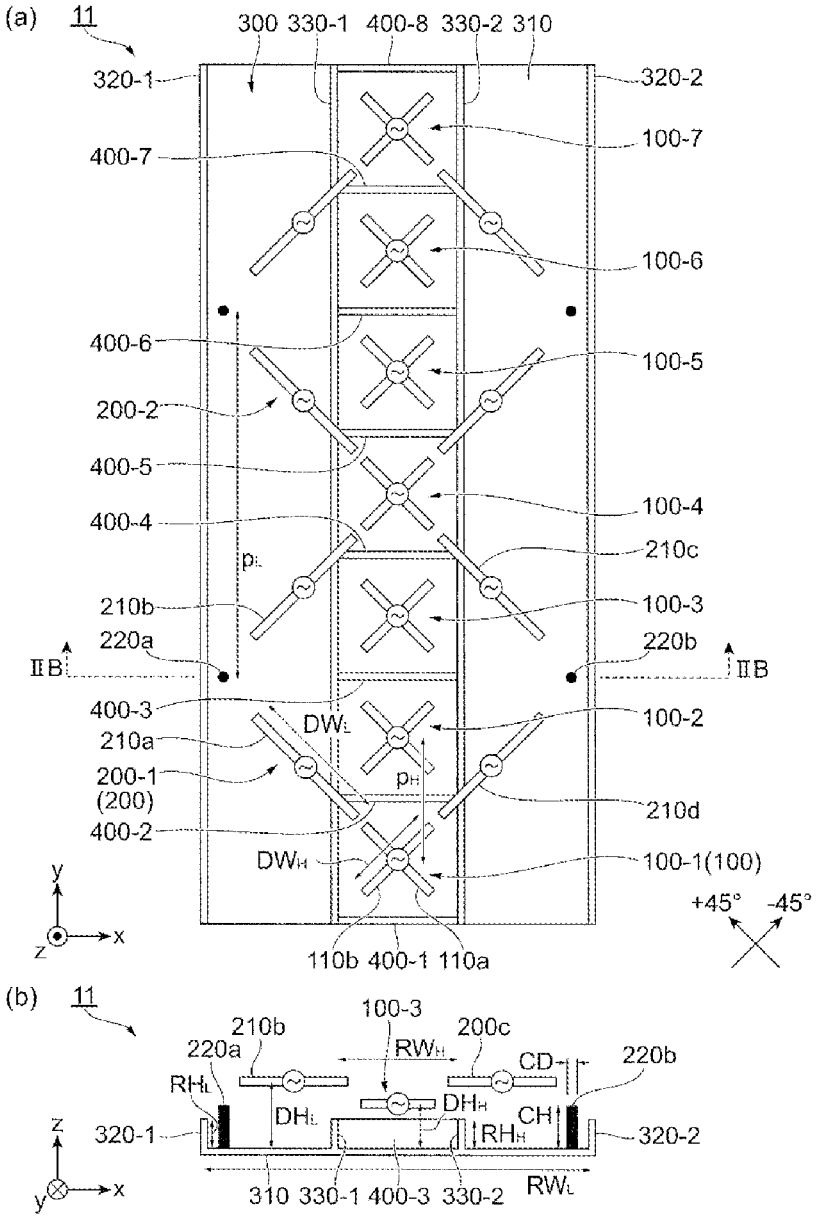
FIG. 2 shows an example of a configuration of an array antenna of the first embodiment. (a) of FIG. 2 is a front view (view of the x-y plane) of the array antenna, and (b) of FIG. 2 is a cross-sectional view (view of the x-z plane) of the array antenna taken along the line IIB-IIB in (a) of FIG. 2.

As shown in (a) of FIG. 1, xyz coordinates are set for the sector antenna 10-1. Specifically, the vertical direction is defined as y direction. As shown in FIG. 2 described below, taking the sector antenna 10-1 as an example, the direction along a flat part 310 of a reflector 300 of the array antenna 11 is defined as x direction, and the direction vertical to the flat part 310 of the reflector 300 is defined as z direction. The x direction is the horizontal direction, the y direction is the vertical direction, y-z plane is the vertical plane, and x-z plane is the horizontal plane.

As shown in (b) of FIG. 1, the base station antenna 1 transmits and receives radio waves within the cell 2. The cell 2 is divided into multiple sectors 3-1 to 3-3 (hereinafter referred to as sectors 3 when they are not distinguished from each other) respectively corresponding to the sector antennas 10-1 to 10-3. The sector antennas 10-1 to 10-3 are set up such that a main lobe 13 of radio waves transmitted and received by their respective array antennas 11 face a corresponding one of the sectors 3-1 to 3-3.

In FIG. 1, the base station antenna 1 includes three sector antennas 10-1 to 10-3 and the corresponding sectors 3-1 to 3-3, but the number of the sector antennas 10 and the sectors 3 may be more or less than three. In (b) of FIG. 1, the sectors 3 are formed by equally dividing the cell 2 into three parts (central angle: 120 degrees). However, the sectors 3 need not to be equal to each other; one of the sectors 3 may be wider or narrower than the other sectors 3.

Each of the sector antennas 10 is connected to transmitting and receiving cables 14-1 to 14-4 for sending transmission signals and reception signals to the array antenna 11. The transmitting and receiving cables 14-1 and 14-2 send transmission signals and reception signals of radio waves of mutually orthogonal polarizations in the high frequency band. The transmitting and receiving cables 14-3 and 14-4 send transmission signals and reception signals of radio waves of mutually orthogonal polarizations in the low frequency band.

The transmitting and receiving cables 14-1 to 14-4 are connected to a transmitting and receiving unit (not shown) installed in a base station (not shown) and configured to generate transmission signals and receive reception signals. The transmitting and receiving cables 14-1 to 14-4 are coaxial cables, for example.

The base station antenna 1, the sector antennas 10, and the array antennas 11 can transmit and receive radio waves due to antenna reversibility.

The sector antennas 10 each may include a distribution and combination circuit configured to distribute or combine transmission and reception signals for multiple antennas (antennas 100-1 to 100-7, 200-1, and 200-2 in FIG. 2 described later) in the array antenna 11, and may also include a phase shifter configured to differentiate phases of the transmission and reception signals between the multiple antennas. Differentiating phases of the transmission and reception signals between the antennas can make the radiation angle of radio wave (beam) inclined (tilted) toward the ground direction.

<Array Antenna 11>

FIG. 2 shows an example of a configuration of the array antenna 11 of the first embodiment. (a) of FIG. 2 is a front view (view of the x-y plane) of the array antenna 11, and (b) of FIG. 2 is a cross-sectional view (view of the x-z plane) of the array antenna 11 taken along the line IIB-IIB in (a) of FIG. 2. Taking the sector antenna 10-1 shown in (a) of FIG. 1 as an example, the array antenna 11 will be described.

The array antenna 11 includes antennas 100-1 to 100-7 (hereinafter referred to as antennas 100 when they are not distinguished from each other) configured to transmit and receive radio waves of mutually orthogonal polarizations in the high frequency band, and antennas 200-1 and 200-2 (hereinafter referred to as antennas 200 when they are not distinguished from each other) configured to transmit and receive radio waves of mutually orthogonal polarizations in the low frequency band.

The array antenna 11 further includes, on one side thereof, the reflector 300 on which the antennas 100-1 to 100-7, 200-1, and 200-2 are arranged, and partitions 400-1 to 400-8 (hereinafter referred to as partitions 400 when they are not distinguished from each other) placed between the antennas 100-1 to 100-7 in the y direction and at respective ends thereof in the y direction.

The reflector 300 is an example of the reflective member.

The antennas 100-1 to 100-7 are arranged in the y direction at the center of the reflector 300 in the x direction.

The antennas 200-1 and 200-2 are also arranged in the y direction at the center of the reflector 300 in the x direction.

That is, the array antenna 11 is a dual-polarization and dual-frequency array antenna.

A dual-polarization array antenna is required to reduce the amount of coupling between polarizations (the amount of polarization coupling) over a wide band. The amount of polarization coupling refers to S-parameter S21 between antenna elements (dipole antennas 110*a* and 110*b* or dipole antennas 210*a*, 210*b*, 210*c*, and 210*d* described below) respectively transmitting and receiving differently polarized waves.

A dual-frequency array antenna only has limited flexibility in arrangement of antennas for transmitting and receiving high-frequency band radio waves (the antennas 100-1 to 100-7 in FIG. 1) and antennas for transmitting and receiving low-frequency band radio waves (the antennas 200-1 and 200-2 in FIG. 1). For this reason, depending on antenna arrangement, grating lobes may occur in the directivity on the vertical plane (y-z plane) of the antenna for transmitting and receiving high-frequency band radio waves, and symmetry of the directivity on the horizontal plane (x-z plane) of the antenna for transmitting and receiving low-frequency band radio waves may be impaired. That is, the directivity may degrade depending on antenna arrangement. Thus, the antenna for transmitting and receiving high-frequency band radio waves and the antenna for transmitting and receiving low-frequency band radio waves are required to be arranged so as to avoid degradation of the directivity.

Further, the mobile communication base station antenna 1 is required to minimize occurrence of intermodulation distortion and white noise.

Each of the antennas 100 has a cross dipole structure where two dipole antennas 110*a* and 110*b* are arranged so as to cross each other, as depicted by the antenna 100-1. Assuming that −y direction coincides with the direction toward the ground, the dipole antenna 110*a* transmits and receives +45 degree polarized radio waves, and the dipole antenna 110*b* transmits and receives −45 degree polarized radio waves.

When the dipole antennas 110*a* and 110*b* are not distinguished from each other, they are referred to as dipole antennas 110. The symbol at the center of each dipole antenna 110 indicates a feeding point. Each of the dipole antennas 110 is an example of the antenna element.

The antennas 100 are arranged in the y direction at intervals $p_H$.

The +45 degree polarization is an example of the first polarization, and the −45 degree polarization is an example of the second polarization.

Each of the antennas 200 includes four dipole antennas 210*a*, 210*b*, 210*c*, 210*d*, and two conductive members 220*a* and 220*b*, as depicted by the antenna 200-1. The dipole antennas 210*a* to 210*d* have the same configuration. Accordingly, when these dipole antennas are not distinguished from each other, they are hereinafter referred to as dipole antennas 210. The symbol at the center of each dipole antenna 210 indicates a feeding point. Each of the dipole antenna 210 is an example of the antenna element.

The two conductive members 220*a* and 220*b* have the same configuration. Accordingly, they are hereinafter referred to as conductive members 220 when they are not distinguished from each other.

The dipole antennas 210*a* and 210*b* are arranged with their respective one ends close to each other. Near the point of intersection where the dipole antennas 210*a* and 210*b* meet when extended (i.e. the point of intersection of two virtual lines respectively extended along the dipole antennas 210*a* and 210*b*), the conductive member 220*a* is located close to the one ends of the dipole antennas 210*a* and 210*b*.

The dipole antennas 210*c* and 210*d* are arranged with their respective one ends close to each other. Near the point of intersection where the dipole antennas 210*c* and 210*d* meet when extended (i.e. the point of intersection of two virtual lines respectively extended along the dipole antennas 210*c* and 210*d*), the conductive member 220*b* is located close to the one ends of the dipole antennas 210*c* and 210*d*.

Also, the dipole antennas 210*a* and 210*d* are arranged with their respective other ends close to each other. The other ends of the dipole antenna 210*a* and the dipole antenna 210*d* are located close to the antenna 100-1.

Likewise, the dipole antennas 210*b* and 210*c* are arranged with their respective other ends close to each other. The other ends of the dipole antennas 210*b* and 210*c* are located close to the antenna 100-4.

The dipole antennas 210*a*, 210*b*, and the conductive member 220*a* are symmetric to the dipole antennas 210*c*, 210*d*, and the conductive member 220*b* about a y directional axis laid at the center in the x direction of the flat part 310 of the reflector 300.

Assuming that the −y direction coincides with the direction toward the ground, the dipole antennas 210*a*, 210*c* transmit and receive radio waves of +45 degree polarization, and the dipole antennas 210*b*, 210*d* transmit and receive radio waves of −45 degree polarization. Accordingly, the polarization directions of the radio waves received by the dipole antennas 210*a*, 210*c* and the radio waves received by the dipole antennas 210*b*, 210*d* are different by 90 degrees.

Signals are divided or combined for a pair of the opposing dipole antennas 210*a*, 210*c* and for a pair of the opposing dipole antennas 210*b*, 210*d*, each at the same phase and the same amplitude.

That is, a set of ±45 degree dual-polarization antennas is composed of: the four dipole antennas 210*a*, 210*b*, 210*c*, and 210*d*; the conductive member 220*a* located close to the one ends of the dipole antennas 210*a*, 210*b* and near the point of intersection of lines extended from the dipole antennas 210*a*, 210*b*; and the conductive member 220*b* located close to the one ends of the dipole antennas 210*c*, 210*d* and near the point of intersection of lines extended from the dipole antennas 210*c*, 210*d*.

Thus, the four dipole antennas 210*a*, 210*b*, 210*c*, and 210*d* are located on respective sides of a quadrangle. Preferably, the quadrangle is a square with the feeding point at the center of each side.

Placing the four dipole antennas 210*a*, 210*b*, 210*c*, and 210*d* at the positions corresponding to respective sides of a square can increase the symmetry in the horizontal direction (x direction) and in the vertical direction (y direction) and also increase the symmetry of the directivity on the horizontal plane (x-z plane) and on the vertical plane (y-z plane).

The antennas 200 (the antennas 200-1, 200-2) are arranged in the y direction at intervals $p_L$.

Here, when something is described as being located "close" to a part of an object, it means that that thing is closer to the part of the object than the other parts thereof and located within a quarter of the wavelength $\lambda_{0L}$, which is designed in the low frequency band.

Also, when something is described as being located "near the point of intersection", it means that that thing is located within a quarter of the wavelength $\lambda_{0L}$ from the point of intersection.

Figure 5:
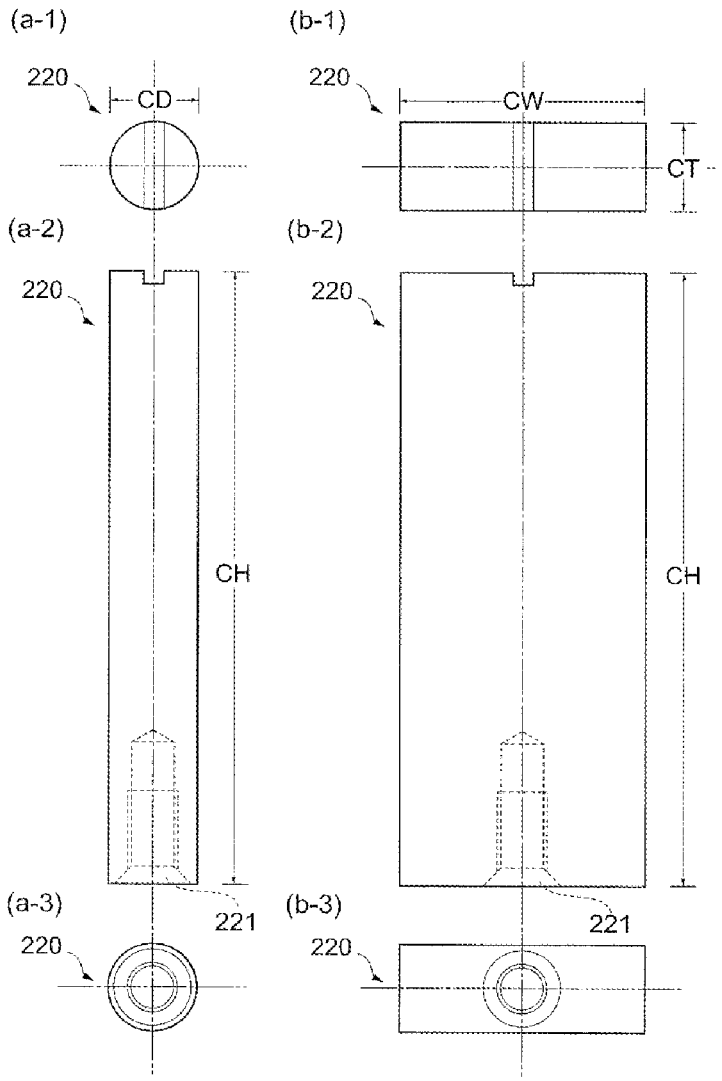
FIG. 5 shows explanatory diagrams of a conductive member. (a-1), (a-2), and (a-3) of FIG. 5 are a top view, a front view, and a bottom view, respectively, of the conductive member when it has a columnar shape. (b-1), (b-2), and (b-3) of FIG. 5 are a top view, a front view, and a bottom view, respectively, of the conductive member when it has a plate shape, which is a modified example of the conductive member.

As shown in (b) of FIG. 2, each of the conductive members 220 (the conductive members 220*a*, 220*b*) is a cylinder with the diameter CD and the height CH (see (a-1) to (a-3) of FIG. 5 given below). Each of the conductive members 220 is fixed at its one end into a through-hole in the flat part 310 of the reflector 300 with a screw (not shown). Preferably, the conductive members 220 are directly connected to the flat part 310 of the reflector 300.

The conductive members 220 are made of a conductive material such as aluminum.

Preferably, each of the conductive members 220 is connected to the flat part 310 of the reflector 300 at one point. Connecting the conductive member 220 to the flat part 310 of the reflector 300 at one point can reduce occurrence of intermodulation distortion and white noise, as compared to when the conductive member 220 is connected to the flat part 310 at multiple points or in linear or surface contact.

Alternatively, the conductive member 220 may be fixed to the flat part 310 of the reflector 300 through an insulating material and high-frequency connected by capacitive coupling. This can more easily reduce occurrence of intermodulation distortion and white noise, as compared when the conductive member 220 is directly connected.

The conductive member 220 may be a prism or a rod-like member with any other cross-section. Still alternatively, the conductive member 220 may be a plate-like member, as described below.

The dipole antenna 210*a* is an example of the first antenna element, the dipole antenna 210*b* is an example of the second antenna element, the dipole antenna 210*c* is an example of the third antenna element, and the dipole antenna 210*d* is an example of the fourth antenna element. The conductive member 220*a* is an example of the conductive member or the first conductive member, and the conductive member 220*b* is an example of the other conductive member or the second conductive member.

Instead of the conductive member 220*a*, a conductive member 220 similar to the conductive member 220*a* may be placed near the point of intersection of lines extended from the dipole antennas 210*a*, 210*d* and close to the other ends of the dipole antennas 210*a*, 210*d*. Likewise, instead of the conductive member 220*b*, a conductive member 220 similar to the conductive member 220*b* may be placed near the point of intersection of lines extended from the dipole antennas 210*b*, 210*c* and close to the other ends of the dipole antennas 210*b*, 210*c*.

In the above description, the antennas 200 include four dipole antennas 210 and two conductive members 220. This is to increase the symmetry of the antennas 200 in the horizontal and vertical directions.

However, the antennas 200 do not necessarily include four dipole antennas 210 and two conductive members 220. In other words, the antennas 200 may include two dipole antennas 210 and one conductive member 220. Specifically, the antennas 200 may include the dipole antennas 210*a*, 210*b*, and the conductive member 220*a* placed near the point of intersection of lines extended from the dipole antennas 210*a*, 210*b* and close to the one ends of the dipole antennas 210*a*, 210*b*, as depicted by the antenna 200-1. In this case, the dipole antenna 210*a* is an example of the first antenna element, the dipole antenna 210*b* is an example of the second antenna element, and the conductive member 220*a* is an example of the conductive member.

Alternatively, the antennas 200 may include the dipole antennas 210*c*, 210*d*, and the conductive member 220*b* placed near the point of intersection of lines extended from the dipole antennas 210*c*, 210*d* and close to the one ends of the dipole antennas 210*c*, 210*d*, as depicted by the antenna 200-1. In this case, the dipole antenna 210*c* is an example of the first antenna element, the dipole antenna 210*d* is an example of the second antenna element, and the conductive member 220*b* is an example of the conductive member.

The length of the dipole antenna depends on the wavelength of radio waves to be transmitted and received, and increases with increase in the wavelength. Accordingly, the length $DW_H$ of each dipole antenna 110 of the antennas 100 for transmitting and receiving high-frequency band radio waves is shorter than the length $DW_L$ of each dipole antenna 210 of the antennas 200 for transmitting and receiving low-frequency band radio waves. The length $DW_H$ of the dipole antenna 110 and the length $DW_L$ of the dipole antenna 210 of the antennas 200 refer to their end-to-end lengths when projected onto the flat part 310 of the reflector 300.

For example, the antennas 100 (the antennas 100-1 to 100-7) for transmitting and receiving high-frequency band radio waves are arranged at intervals $p_H$ of about $0.8\lambda_{0H}$ to reduce occurrence of grating lobes in the directivity on the vertical plane (y-z plane).

On the other hand, the antennas 200 (the antennas 200-1, 200-2) transmitting and receiving low-frequency band radio waves are arranged such that one antenna 200 is placed for three antennas 100 transmitting and receiving high-frequency band radio waves. That is, the interval $p_L$ in the array of the antennas 200 is three times the interval $p_H$ in the array of the antennas 100 ($p_L=3\times p_H$). The interval $p_L$ of the antennas 200 transmitting and receiving low-frequency band radio waves is set to about $0.7\lambda_{0L}$, for example.

That is, a position between the antenna 100-2 and the antenna 100-3 in the y direction corresponds to a position in the y direction where the conductive members 220*a*, 220*b* of the antenna 200-1 are located. In other words, the dipole antennas 210*a*, 210*b*, 210*c*, and 210*d* are located so as to surround the two antennas 100 (the antennas 100-2, 100-3).

The antenna 100-1 is located outside of the antenna 200-1 in the −y direction, and the antenna 100-4 is located outside of the antenna 200-1 in the +y direction.

That is, the antennas 200 are arranged repeatedly in the y direction with the y directional length of three antennas 100 (interval $p_H$) being a repeat unit (interval).

In the first embodiment, two antennas 100 transmitting and receiving high-frequency band radio waves are placed in the area surrounded by four dipole antennas 210 placed on respective sides of the square constituting the antenna 200, and one antenna 100 is placed between two antennas 200.

In this way, the interval $p_L$ of the antennas 200 transmitting and receiving low-frequency band radio waves is made three times the interval $p_H$ of the antennas 100 transmitting and receiving high-frequency band radio waves. This can maintain the symmetry when viewed from each antenna and can also reduce occurrence of grating lobes in the directivity on the vertical plane (y-z plane) of the antennas 100 transmitting and receiving high-frequency band radio waves, resulting in favorable directivity.

The entire length of each dipole antenna 210 of the antennas 200 is set according to the wavelength of low-frequency band radio waves to be transmitted and received. Thus, to maintain the above-described relationship between the interval $p_L$ and the interval $p_H$, the dipole antenna 210 is bent at both ends to have the length $DW_L$. The shape of the dipole antenna 210 will be described later.

The reflector 300 includes the flat part 310, and two standing parts 320-1, 320-2 at respective ends of the reflector 300 in the ±x direction (when they are not distinguished from each other, they are referred to as standing parts 320). The standing parts 320-1, 320-2 rise from the flat part 310 in the z direction and extend in the y direction.

The reflector 300 further includes two standing parts 330-1, 330-2 (when they are not distinguished from each other, they are referred to as standing parts 330) between the center of the flat part 310 and the respective ends in the ±x direction. The standing parts 330-1, 330-2 rise from the flat part 310 in the z direction and extend in the y direction.

The antennas 100-1 to 100-7 are arranged at the intervals $p_H$ in the y direction at the center in the x direction of the flat part 310 of the reflector 300.

The two standing parts 330-1, 330-2 are placed so as to sandwich the antennas 100-1 to 100-7 from the ±x direction.

Also, the antennas 200-1, 200-2 are arranged at the intervals $p_L$ in the y direction between the standing part 320-1 and the standing part 320-2.

The flat part 310 and the standing parts 320-1, 320-2 of the reflector 300 may be integrally formed by, for example, bending a flat plate. Alternatively, these may be separate components and may be coupled by screws and the like. Also, the flat part 310 and the standing parts 320-1, 320-2 may be capacitively coupled via an insulating material.

The standing parts 330-1, 330-2 may be separate members from the flat part 310 and may be coupled to the flat part 310 of the reflector 300 with screws and the like. At this time, the flat part 310 and the standing parts 330-1, 330-2 may be capacitively coupled via an insulating material.

Alternatively, the reflector 300 may be composed of a stack of a member having the standing parts 330-1, 330-2 at respective ends thereof, which can be formed by, for example, bending a flat plate, and a member having the standing parts 320-1, 320-2 at respective ends thereof.

The standing parts 320-1, 320-2, 330-1, and 330-2 of the reflector 300 are vertical relative to the flat part 310; however, they may be oblique relative to the flat part 310. For example, the reflector 300 is made of a conductive material such as aluminum.

In the array of the antennas 100-1 to 100-7, the partitions 400-1 to 400-8 are placed between each two adjacent antennas 100 and at respective ends of the antennas 100 in the y direction. Similarly to the standing parts 330-1, 330-2 of the reflector 300, the partitions 400-1 to 400-8 are connected to the flat part 310 of the reflector 300 so as to rise from the flat part 310. Also, the partitions 400-1 to 400-8 are connected to the standing parts 330-1, 330-2.

The partitions 400-1 to 400-8 may be capacitively coupled to the flat part 310 of the reflector 300. The partitions 400-1 to 400-8 may also be capacitively coupled to the standing parts 330-1, 330-2 of the reflector 300.

The partitions 400 are vertical relative to the flat part 310 of the reflector 300; however, they may be oblique relative to the flat part 310.

For example, the partitions 400 are made of a conductive material such as aluminum.

The standing parts 330-1, 330-2 of the reflector 300 sandwich the antennas 100 from the ±x direction. The partitions 400 sandwich the antennas 100 from the ±y direction. This makes the antennas 100 electrically symmetric in the x and y directions. This increases the directivity in the x direction (horizontal direction) and the y direction (vertical direction).

All or some of the standing parts 320-1, 320-2, 330-1, 330-2 and the partitions 400-1 to 400-8 may be omitted.

As shown in (b) of FIG. 2, the reflector 300 has the width $RW_L$ between the standing parts 320-1 and 320-2 and the height $RH_L$ from the flat part 310 to the standing parts 320-1 and 320-2. Also, the reflector 300 has the width $RW_H$ between the standing parts 330-1 and 330-2 and the height $RH_H$ from the flat part 310 to the standing parts 330-1 and 330-2 and the partitions 400-1 to 400-8.

For example, the width $RW_L$ is $0.7\lambda_{0L}$, the height $RH_L$ is $0.07\lambda_{0L}$, the width $RW_H$ is $0.7\lambda_{0H}$, and the height $RH_H$ is $0.15\lambda_{0H}$.

Also, radiation parts of each antenna 100 are situated at the distance of $DH_H$ from the flat part 310, and radiation parts of each antenna 200 are situated at the distance of $DH_L$ from the flat part 310. The radiation parts as referred to here correspond to radiation parts 211, 212 of each dipole antenna 210 as shown in (a) of FIG. 3, which will be described later.

For example, the distance $DH_H$ is $0.25\lambda_{0H}$, and the distance $DH_L$ is $0.2\lambda_{0L}$.

These dimensions and the positions of the standing parts 330-1, 330-2 on the flat part 310 of the reflector 300 may be changed as appropriate according to factors such as required directivity of the array antenna 11.

<Dipole Antenna 210>

Figure 3:
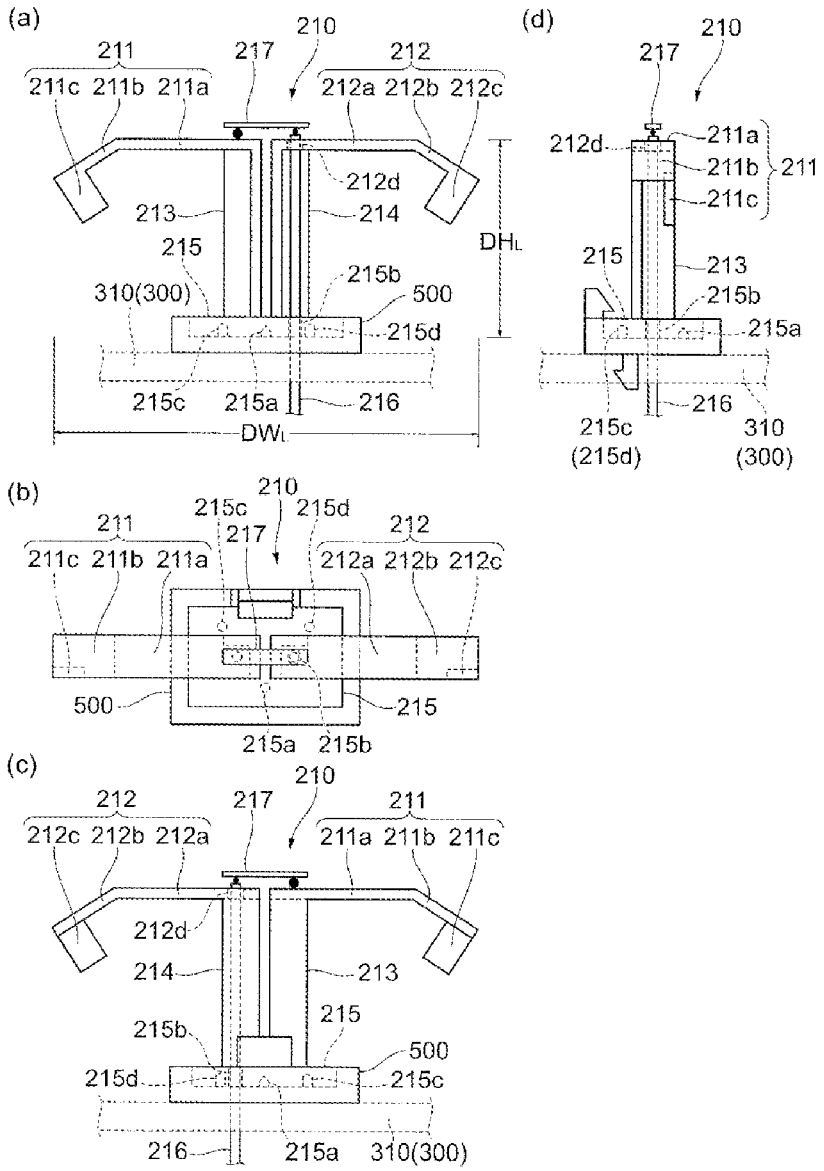
FIG. 3 shows detailed views of each dipole antenna of antennas. (a) of FIG. 3 is a front view, (b) of FIG. 3 is a top view of (a) of FIG. 3, (c) of FIG. 3 is a rear view, and (d) of FIG. 3 is a side view of (a) of FIG. 3.

FIG. 3 shows detailed views of each dipole antenna 210 of the antennas 200. (a) of FIG. 3 is a front view, (b) of FIG. 3 is a top view of (a) of FIG. 3, (c) of FIG. 3 is a rear view, and (d) of FIG. 3 is a side view of (a) of FIG. 3.

(a) and (b) of FIG. 3 also show the flat part 310 of the reflector 300.

As shown in (a) of FIG. 3, the dipole antenna 210 includes radiation parts 211, 212, legs 213, 214, and a base 215. The dipole antenna 210 further includes a feeding cable 216 and a feeding plate 217. The dipole antenna 210 further includes a spacer 500 between the base 215 and the flat part 310 of the reflector 300. Note that the spacer 500 is not essential.

The radiation parts 211, 212, the legs 213, 214, and the base 215 of the dipole antenna 210 are formed by cutting a conductive material such as aluminum. Alternatively, these components may be formed by die casting.

The spacer 500 is made of a dielectric material such as tetrafluoroethylene and polyacetal.

The feeding cable 216 is a coaxial cable for carrying transmission signals and reception signals.

The feeding plate 217 is made of a conductive material such as copper.

A description will be given of the dipole antenna 210 with reference to (a) of FIG. 3 in particular. Here, the description will focus on the configuration of the dipole antenna 210 excluding the spacer 500, which will be separately described later.

The radiation part 211 includes a plate-like first portion 211*a* that extends from the leg 213 parallel to the flat part 310 of the reflector 300. The radiation part 211 further includes a plate-like second portion 211*b* that is continuous from the first portion 211*a* and gradually comes closer to the flat part 310 of the reflector 300. The radiation part 211 further includes a plate-like third portion 211*c* that extends from a side at the distal end of the second portion 211*b* toward the flat part 310 of the reflector 300. Unlike the first portion 211*a* and the second portion 211*b* facing upward, the third portion 211*c* faces the front side. That is, the third portion 211*c* is provided continuously from the side at the distal end of the second portion 211*b* (see (b) and (d) of FIG. 3).

The radiation part 212 includes a plate-like first portion 212*a* that extends from the leg 214 parallel to the flat part 310 of the reflector 300. The radiation part 212 further includes a plate-like second portion 212*b* that is continuous from the first portion 212*a* and gradually comes closer to the flat part 310 of the reflector 300. The radiation part 212 further includes a plate-like third portion 212*c* that extends from a side at the distal end of the second portion 212*b* toward the flat part 310 of the reflector 300. Similarly to the third portion 211*c*, the third portion 212*c* faces the front side. That is, the third portion 212*c* is provided continuously from the side at the distal end of the second portion 212*b*. The third portion 211*c* and the third portion 212*c* are provided on the same side (front side) (see (b) and (d) of FIG. 3).

The first portion 212*a* of the radiation part 212 is provided with a through-hole 212*d* connected to an outer conductor of the feeding cable 216 and allowing for passage of an inner conductor and a dielectric around the inner conductor.

The leg 213 has an L cross-section (see (b) of FIG. 3), and its one end (on the upper side) is connected to an end of the first portion 211*a* of the radiation part 211. That is, the L cross-section of the leg 213 is connected to the end (on the side not connected to the second portion 211*b*) of the first portion 211*a* of the radiation part 211. The other end (on the lower side) of the leg 213 is connected to the base 215.

Similarly to the leg 213, one end (on the upper side) of the leg 214 is connected to an end of the first portion 212*a* of the radiation part 212, and the other end (on the lower side) of the leg 214 is connected to the base 215.

The one ends (on the upper side) of the legs 213, 214 respectively connected to the radiation parts 211, 212 are separated from each other. However, the other ends (on the lower side) of the legs 213, 214 are connected to each other by being connected to the flat part 310 of the reflector 300. That is, the other ends (on the lower side) of the legs 213, 214 are directly connected.

Each of the legs 213, 214 is an example of the support part.

The base 215 is configured to be fixed to the flat part 310 of the reflector 300 with the spacer 500 in-between. Accordingly, the base 215 includes on its bottom face (on the reflector 300) a screw hole 215*a* for fixing the base 215 to the flat part 310 of the reflector 300 with a screw through a through-hole (through-hole 513 of (a) of FIG. 4 described later) of the spacer 500.

Connecting the base 215 to the flat part 310 of the reflector 300 through the spacer 500 made of a dielectric material in this way allows to reduce occurrence of intermodulation distortion and white noise from the connecting surface.

The base 215 includes a through-hole 215*b* for passage of the feeding cable 216 via a through-hole in the spacer 500 (a through-hole 512 in (a) of FIG. 4 described later). The flat part 310 of the reflector 300, to which the base 215 is fixed, is provided with a through-hole (a through-hole 311 in (d) of FIG. 4 described later) for passage of the feeding cable 216.

That is, the feeding cable 216 is inserted from the back side of the reflector 300 through the through-hole (through-hole 311 in (d) of FIG. 4 described later) of the flat part 310 of the reflector 300, the through-hole 512 of the spacer 500, and the through-hole 215*b* of the base 215.

The feeding cable 216 passed through the through-hole 215*b* of the base 215 goes toward the radiation part 212 along the leg 214.

The outer conductor of the feeding cable 216 is connected to the through-hole 212*d* in the first portion 212*a* of the radiation part 212 by solder or other means. Also, the inner conductor of the feeding cable 216 is passed through the through-hole 212*d* in the first portion 212*a* of the radiation part 212 and connected to one end of the feeding plate 217 by solder or other means. The other end of the feeding plate 217 is connected to the first portion 211*a* of the radiation part 211 by solder or other means.

The base 215 further includes recesses 215*c*, 215*d* that engage with protrusions of the spacer 500 (protrusions 511*a*, 511*b* in (a), (b), and (c) of FIG. 4 described later) and thereby position the base 215 relative to the spacer 500.

As described above, the dipole antenna 210 is configured such that the radiation parts 211, 212 include bent portions. That is, the bent portions are the second portion 211*b* and the third portion 211*c* of the radiation part 211 and the second portion 212*b* and the third portion 212*c* of the radiation part 212.

Without the bent portions, the length of the dipole antenna 210, which is a distance between the end of the radiation part 211 and the end of the radiation part 212, is about $\frac{1}{2}\lambda_{0L}$ relative to the wavelength $\lambda_{0L}$ of the radio waves.

To the contrary, the dipole antenna 210 with the bent portions has the length $DW_L$ that is shorter than $\frac{1}{2}\lambda_{0L}$, as shown in FIG. 3.

To put it conversely, the bent portions are only required to be provided so as to make the length $DW_L$ of the dipole antenna 210 shorter than $\frac{1}{2}\lambda_{0L}$. That is, the second portion 211*b* is only required to be provided so as to gradually change its distance from the flat part 310, and the third portion 211*c* is only required to bend and extend from the second portion 211*b*. Likewise, the second portion 212*b* is only required to be provided so as to gradually change its distance from the flat part 310, and the third portion 212*c* is only required to bend and extend from the second portion 212*b*.

The above configuration widens a distance between the ends of each two of the four dipole antennas 210 (the dipole antennas 210*a*, 210*b*, 210*c*, and 210*d*) when they are arranged. This can further reduce the amount of polarization coupling between the adjacent and differently polarized dipole antennas 210.

Even when the frequency $f_{0L}$ designed in the low frequency band is changed, matching with a predetermined frequency band is possible by adjusting the length of the bent portions of each dipole antenna 210, namely the second portion 211*b* and the third portion 211*c* of the radiation part 211 and the second portion 212*b* and the third portion 212*c* of the radiation part 212. Further, equalizing the length $DW_L$ of the dipole antennas 210 or reducing variations in the length $DW_L$ of the dipole antennas 210 can eliminate the need for changing the array of the antennas 100 transmitting and receiving high-frequency band radio waves and the antennas 200 transmitting and receiving low-frequency band radio waves in the array antenna 11 shown in FIG. 2. In other words, this allows for easier design of the array antenna 11.

The antennas 200 transmitting and receiving low-frequency band radio waves are disposed at respective ends of the reflector 300 in the ±x direction, as shown in (a) of FIG. 2. Also, the distance $DH_L$ from the flat part 310 of the reflector 300 is large. Thus, as a result of each dipole antenna 210 having the bent portions (the second portions 211*b*, 212*b* and the third portions 211*c*, 212*c*) in its radiation parts 211, 212, the radome 12 can be small (see (a) of FIG. 1).

<Spacer 500>

Figure 4:
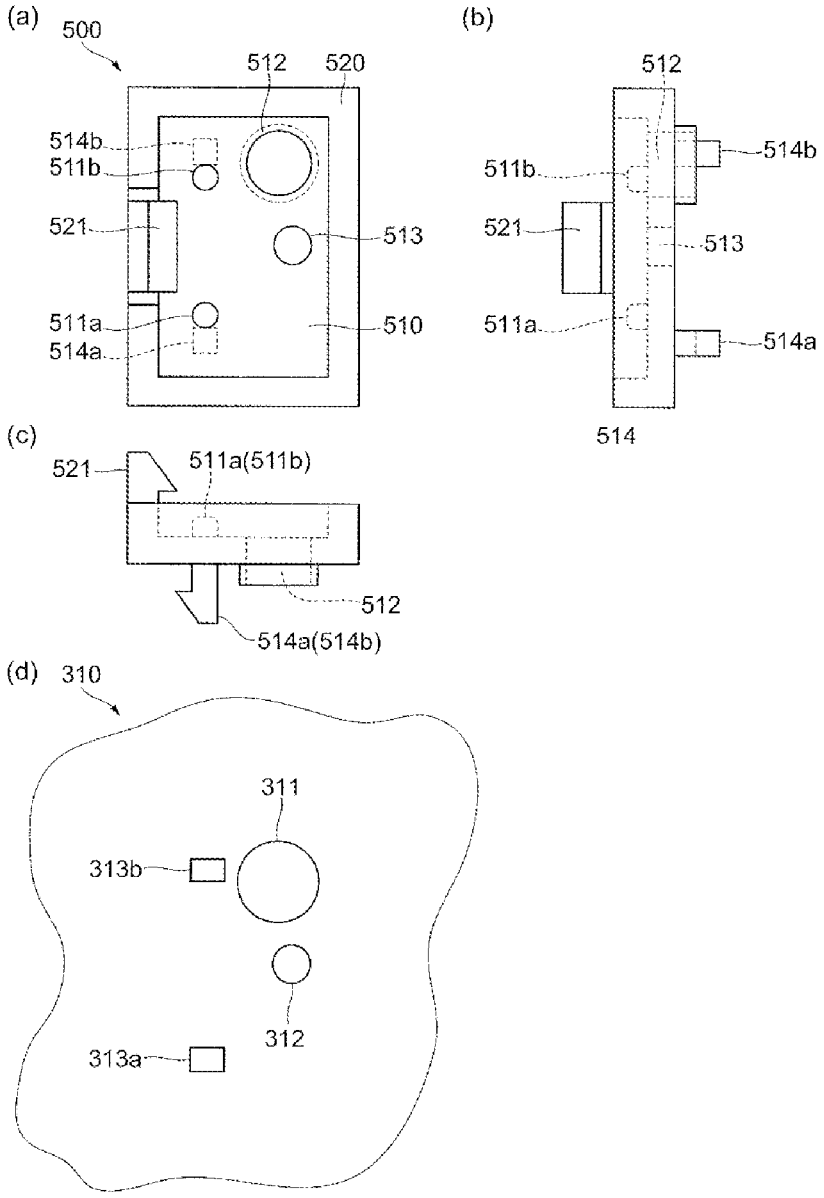
FIG. 4 shows explanatory diagrams of a spacer. (a) of FIG. 4 is a top view, (b) of FIG. 4 is a front view, (c) of FIG. 4 is a side view, and (d) of FIG. 4 shows an example of a part of a flat part of a reflector where the spacer is to be attached.

FIG. 4 shows explanatory diagrams of the spacer 500. (a) of FIG. 4 is a top view, (b) of FIG. 4 is a front view, (c) of FIG. 4 is a side view, and (d) of FIG. 4 shows an example of a part of the flat part 310 of the reflector 300 where the spacer 500 is to be attached.

The spacer 500 is a dielectric member to prevent a direct conduction between the flat part 310 of the reflector 300 and the base 215 of each dipole antenna 210.

The spacer 500 includes a bottom part 510 and an edge part 520 rising from the bottom part 510 to one side (top face side).

As shown in (a), (b), and (c) of FIG. 4, the bottom part 510 includes: protrusions 511*a*, 511*b* (hereinafter referred to as protrusions 511 when they are not distinguished from each other) fitted into the recesses 215*c*, 215*d* of the base 215 of the dipole antenna 210 for positioning of the base 215; a through-hole 512 for passage of the feeding cable 216; and a through-hole 513 for passage of a screw into the screw hole 215*a* of the base 215. Apart around the through-hole 512 for passage of the feeding cable 216 is extended and protruded from the bottom part 510 to the other side (bottom face side) of the bottom part 510.

The edge part 520 includes a base holding lug 521 on the side where the edge part 520 rises upward from the bottom part 510. The base holding lug 521 holds and temporarily fixes the base 215 of the dipole antenna 210. The edge part 520 further includes spacer holding lugs 514*a*, 514*b* (hereinafter referred to as spacer holding lugs 514 when they are not distinguished from each other) on the side opposite to the side where the edge part 520 rises upward from the bottom part 510 and contacting the flat part 310 of the reflector 300. The spacer holding lugs 514*a*, 514*b* hold the spacer 500 and temporarily fix it to the flat part 310 of the reflector 300.

The base holding lug 521 is an example of the base holding member, and the spacer holding lugs 514 are examples of the spacer holding member.

The protrusions 511*a*, 511*b* of the spacer 500 are inserted and fitted into the recesses 215*c*, 215*d*, respectively, of the base 215 of the dipole antenna 210. This mounts the spacer 500 at a predetermined position on the dipole antenna 210. This can prevent displacement of the through-holes 512, 513 even if there is dimensional variation of the dipole antennas 210 and/or the spacers 500 during manufacture thereof. Further, as the base holding lug 521 temporarily fixes the base 215 of the dipole antenna 210 to the spacer 500, efficiency in mounting the spacer 500 greatly improves.

As shown in (d) of FIG. 4, the flat part 310 of the reflector 300 includes, in the part thereof to which the dipole antenna 210 is attached: a through-hole 311 for passage of the feeding cable 216; a through-hole 312 for insertion of a screw into the screw hole 215*a* of the base 215 of the dipole antenna 210 to thereby attach the dipole antenna 210 to the reflector 300; and through-holes 313*a*, 313*b* (hereinafter referred to as through-holes 313 when they are not distinguished from each other) for insertion of the spacer holding lugs 514*a*, 514*b* of the spacer 500 for holding and temporarily fixing the spacer 500.

Now a description will be given of a method for attaching the dipole antenna 210 to the reflector 300.

In fixing the dipole antenna 210 mounted with the spacer 500 to the flat part 310 of the reflector 300, the extended portion of the through-hole 512 of the spacer 500 is inserted into the through-hole 311, and the spacer holding lugs 514*a*, 514*b* of the spacer 500 are inserted into the through-holes 313*a*, 313*b* and hooked on the flat part 310 of reflector 300. Then, a screw is inserted through the through-hole 312 and fixed to the screw hole 215*a* of the base 215 mounted with the spacer 500, whereby the dipole antenna 210 is attached to the reflector 300.

At this time, the spacer holding lugs 514*a*, 514*b* of the spacer 500 are hooked on the through-holes 313*a*, 313*b* in the flat part 310 of the reflector 300. Thus, even with the use of only one screw for fixing the base 215 to the flat part 310 of the reflector 300, no rotation or displacement occurs and the dipole antenna 210 can be securely fixed to the reflector 300. This also greatly facilitates the work of fixing the dipole antenna 210 to the reflector 300.

As the extended portion of the through-hole 512 of the spacer 500 is inserted into the through-hole 311 of the reflector 300, the edge of the through-hole 311 does not damage the feeding cable 216.

Mounting the spacer 500 on the base 215 of the dipole antenna 210 and fixing them to the flat part 310 of the reflector 300 in this way can reduce occurrence of intermodulation distortion and white noise while maintaining work efficiency.

The number of protrusions 511, the number of base holding lugs 521, and the number of spacer holding lugs 514 are not limited to those given above, and may be changed as needed.

<Conductive Member 220>

FIG. 5 shows explanatory diagrams of the conductive member 220. (a-1), (a-2), and (a-3) of FIG. 5 are a top view, a front view, and a bottom view, respectively, of the conductive member 220 when it has a columnar shape. (b-1), (b-2), and (b-3) of FIG. 5 are a top view, a front view, and a bottom view, respectively, of the conductive member 220 when it has a plate shape, which is a modified example of the conductive member 220.

As shown in (a-1) and (a-2) of FIG. 5, the conductive member 220 has a columnar shape, which is an example of the rod-like shape, with the diameter CD and the height CH. As shown in (a-2) and (a-3) of FIG. 5, the conductive member 220 includes at its one end a screw hole 221 for fixing the conductive member 220 to the flat part 310 of the reflector 300. The conductive member 220 is directly connected via the screw hole 221 to the flat part 310 of the reflector 300 with a screw inserted from the rear side of the flat part 310. In other words, the conductive member 220 is directly connected to the flat part 310 of the reflector 300 at one point. This can reduce occurrence of intermodulation distortion and white noise.

The recess (not denoted by a reference numeral) shown in the top view of (a-1) of FIG. 5 is a groove to receive a blade of a screwdriver for fixing the conductive member 220. The conductive member 220 does not necessarily have the groove.

For example, the conductive member 220 has the diameter CD of 9 mm and the height CH of 50 mm. The diameter CD and the height CH may be changed according to the required amount of polarization coupling.

As previously mentioned, the conductive member 220 may be a prism or a rod-like member with any other cross-section.

As shown in (b-1) and (b-2) of FIG. 5, the conductive member 220 in the modified example is a plate, which is an example of the plate-like shape, with the width CW, the thickness CT, and the height CH. As shown in (b-2) and (b-3) of FIG. 5, the conductive member 220 includes at its one end a screw hole 221 for fixing the conductive member 220 to the flat part 310 of the reflector 300. Thus, the conductive member 220 is directly connected to the flat part 310 of the reflector 300 at one point.

<Amount of Polarization Coupling>

Figure 6:
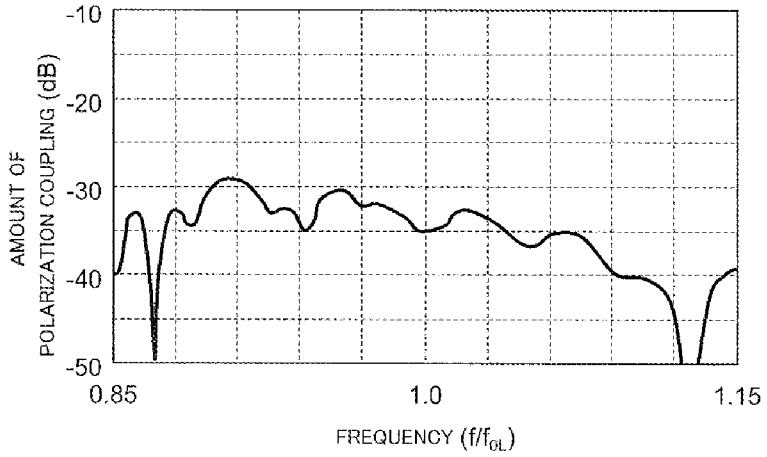
FIG. 6 shows measured values of the amount of polarization coupling of low-frequency band radio waves. (a) of FIG. 6 shows the value measured when the conductive member of the first embodiment is in place, and (b) of FIG. 6 shows the value measured when the conductive member of the first embodiment is not in place.
Figure 6:
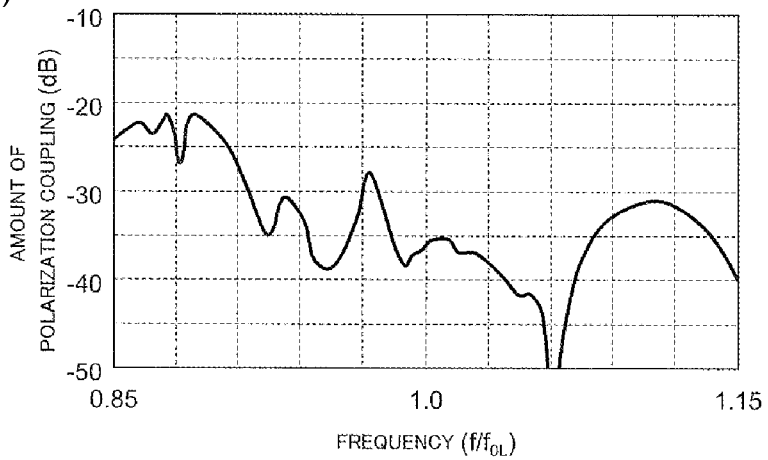

FIG. 6 shows measured values of the amount of polarization coupling of low-frequency band radio waves. (a) of FIG. 6 shows the value measured when the conductive member 220 of the first embodiment is in place, and (b) of FIG. 6 shows the value measured when the conductive member 220 of the first embodiment is not in place. In (a) and (b) of FIG. 6, the horizontal axis represents normalized frequency ($f/f_{0L}$), and the vertical axis represents the amount of polarization coupling (dB). The frequency $f_{0L}$ is set to the 800 MHz band.

The amount of polarization coupling given here refers to S-parameter S21 that is measured between the dipole antenna 210*a* transmitting and receiving +45 degree polarized radio waves and the dipole antenna 210*b* transmitting and receiving −45 degree polarized radio waves included in each antenna 200 of the array antenna 11 having the above numerical values given by way of example.

As shown in (a) of FIG. 6, the maximum amount of polarization coupling in the first embodiment is about −28 dB. As shown in (b) of FIG. 6, in contrast, the maximum amount of polarization coupling when the conductive member 220 of the first embodiment is not in place is about −22 dB. This means that the first embodiment achieves improvement in the amount of polarization coupling by about 6 dB. The figures also show that the first embodiment can reduce the amount of polarization coupling over a wide band of 0.85 $f/f_{0L}$ to 1.15 $f/f_{0L}$.

Figure 7:
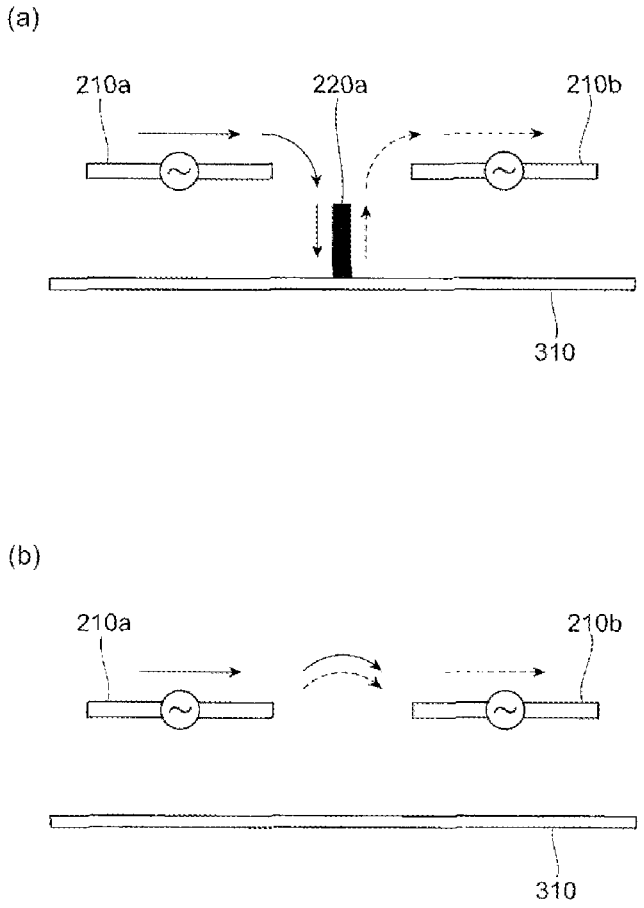
FIG. 7 shows explanatory diagrams of the effect of the conductive member. (a) of FIG. 7 shows the case where the conductive member of the first embodiment is in place, and (b) of FIG. 7 shows the case where the conductive member of the first embodiment is not in place.

FIG. 7 shows explanatory diagrams of the effect of the conductive member 220. (a) of FIG. 7 shows the case where the conductive member 220*a* of the first embodiment is in place, and (b) of FIG. 7 shows the case where the conductive member 220 of the first embodiment is not in place. (a) of FIG. 7 shows the dipole antennas 210*a*, 210*b* and the conductive member 220*a* among the components of the antenna 200-1 shown in FIG. 2. In (a) and (b) of FIG. 7, a current excited by the dipole antenna 210*a* is indicated by solid arrows, and a current excited by the dipole antenna 210*b* is indicated by dashed arrows.

As shown in (a) of FIG. 7, with the conductive member 220*a* of the first embodiment in place, a current also flows through the conductive member 220*a* because of the current excited by the dipole antenna 210*a* and the current excited by the dipole antenna 210*b*. However, one end of the conductive member 220*a* is short-circuited to the flat part 310 of the reflector 300, and thus the conductive member 220*a* produces shielding effect.

As shown in (b) of FIG. 7, in contrast, without the conductive member 220 of the first embodiment, the current excited by the dipole antenna 210*a* is directly coupled to the dipole antenna 210*b*. Likewise, the current excited by the dipole antenna 210*b* is directly coupled to the dipole antenna 210*a*.

Thus, the conductive member 220 shields each other's radio waves and prevents interaction between them. This is considered to be a reason for reduced polarization coupling.

Here, placing the conductive member 220 near the point of intersection of virtual lines respectively extended along the antennas 200 transmitting and receiving radio waves of mutually different polarizations means that the conductive member 220 shields the radio waves at the point where directions of the electric field vibration of polarized waves cross each other. This is considered to be a reason for more effectively reduced polarization coupling.

Second Embodiment

In the array antenna 11 of the first embodiment, the multiple antennas 100 transmitting and receiving high-frequency band radio waves are arranged at the center of the reflector 300 in the x direction, and the multiple antennas 200 transmitting and receiving low-frequency band radio waves are arranged on both sides of the array of the multiple antennas 100.

In an array antenna 15 of the second embodiment, the multiple antennas 200 transmitting and receiving low-frequency band radio waves are arranged at the center of the reflector 300 in the x direction, and the multiple antennas 100 transmitting and receiving high-frequency band radio waves are arranged on both sides of the multiple antennas 200 in the x direction.

Other configurations are similar to those in the first embodiment. Accordingly, the below description will focus on difference between the array antenna 15 and the array antenna 11 of the first embodiment.

<Array Antenna 15>

Figure 8:
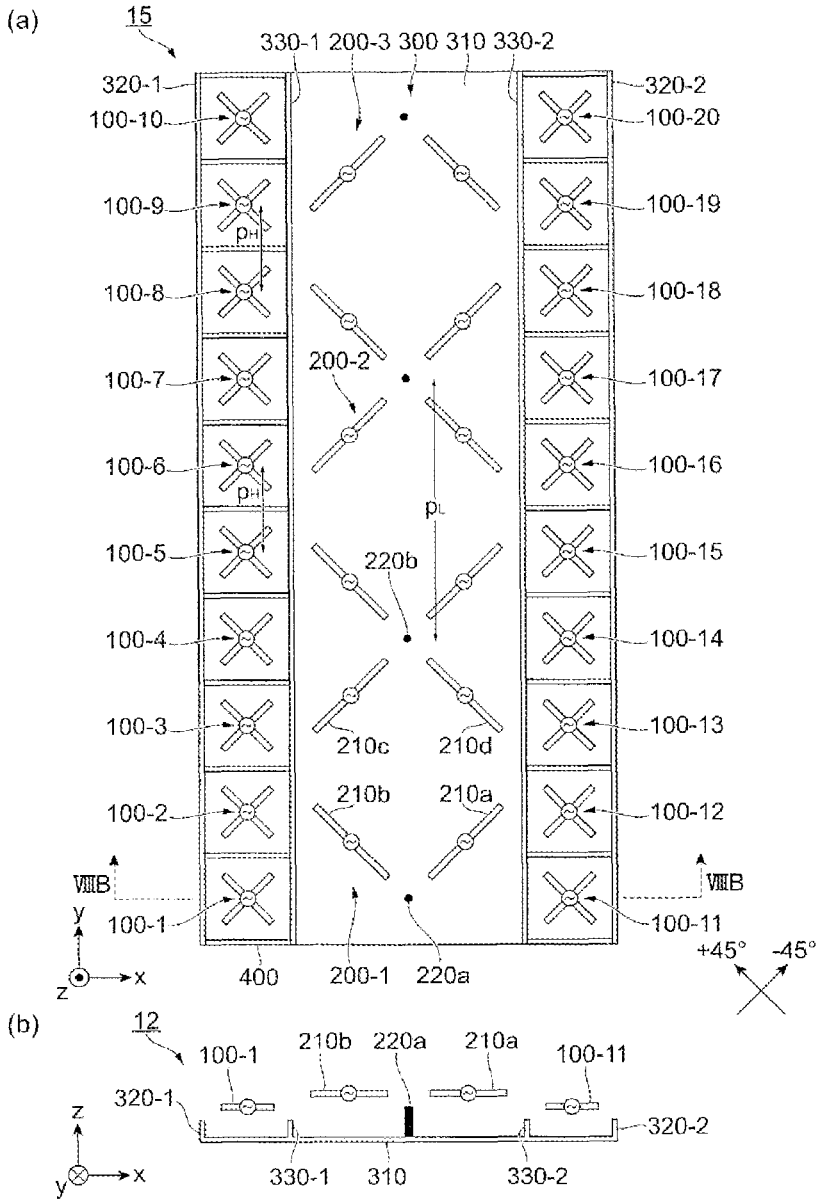
FIG. 8 shows an example of a configuration of the array antenna of the second embodiment. (a) of FIG. 8 is a front view (view of the x-y plane) of the array antenna, and (b) of FIG. 8 is a cross-sectional view (view of the x-z plane) of the array antenna taken along the line VIIIB-VIIIB in (a) of FIG. 8.

FIG. 8 shows an example of a configuration of the array antenna 15 of the second embodiment. (a) of FIG. 8 is a front view (view of the x-y plane) of the array antenna 15, and (b) of FIG. 8 is a cross-sectional view (view of the x-z plane) of the array antenna 15 taken along the line VIIIB-VIIIB in (a) of FIG. 8. Taking the sector antenna 10-1 shown in (a) of FIG. 1 as an example, the array antenna 15 will be described.

The array antenna 15 includes antennas 100-1 to 100-10 and 100-11 to 100-20 (hereinafter referred to as antennas 100 when they are not distinguished from each other) configured to transmit and receive radio waves of mutually orthogonal polarizations in the high frequency band, and antennas 200-1 to 200-3 (hereinafter referred to as antennas 200 when they are not distinguished from each other) configured to transmit and receive radio waves of mutually orthogonal polarizations in the low frequency band.

At the center of the reflector 300 in the x direction, the antennas 200-1 to 200-3 are arranged in the y direction at intervals $p_L$.

On the left side (−x direction side) of the array of the antennas 200-1 to 200-3, the antennas 100-1 to 100-10 are arranged in the y direction at intervals $p_H$.

On the right side (+x direction side) of the array of the antennas 200-1 to 200-3, the antennas 100-11 to 100-20 are arranged in the y direction at intervals $p_H$.

In this embodiment too, the interval $p_L$ in the array of the antennas 200 is three times the interval $p_H$ in the array of the antennas 100 ($p_L=3\times p_H$).

Similarly to the first embodiment, the reflector 300 includes the flat part 310, and two standing parts 320-1, 320-2 at respective ends of the reflector 300 in the ±x direction. The standing parts 320-1, 320-2 rise from the flat part 310 in the z direction and extend in the y direction. The reflector 300 further includes two standing parts 330-1, 330-2 between the center of the flat part 310 and the respective ends in the ±x direction. The standing parts 330-1, 330-2 rise from the flat part 310 in the z direction and extend in the y direction.

The antennas 200-1 to 200-3 are placed between the standing part 330-1 and the standing part 330-2.

The antennas 100-1 to 100-10 are arranged between the standing part 320-1 and the standing part 330-1, and the antennas 100-11 to 100-20 are arranged between the standing part 320-2 and the standing part 330-2.

Similarly to the first embodiment, the partition 400 is placed between each two of the antennas 100-1 to 100-10 and 100-11 to 100-20. The reference numerals for individual partitions are omitted in FIG. 8.

The antennas 100 are similar to those in the first embodiment, and thus detailed description thereof will be omitted.

Each of the antennas 200 includes four dipole antennas 210*a*, 210*b*, 210*c*, 210*d* and two conductive members 220*a* and 220*b*, as depicted by the antenna 200-1. Note that the antenna 200-1 is the same as the antenna 200-1 of the first embodiment shown in FIG. 2 when the antenna 200-1 of the first embodiment is rotated by 90 degrees about the z axis.

That is, the dipole antennas 210*a* and 210*b* are arranged with their respective one ends close to each other. Near the point of intersection where the dipole antennas 210*a* and 210*b* meet when extended (i.e. the point of intersection of two virtual lines respectively extended along the dipole antennas 210*a* and 210*b*), the conductive member 220*a* is located close to the one ends of the dipole antennas 210*a* and 210*b*.

The dipole antennas 210*c* and 210*d* are arranged with their respective one ends close to each other. Near the point of intersection where the dipole antennas 210*c* and 210*d* meet when extended (i.e. the point of intersection of two virtual lines respectively extended along the dipole antennas 210*c* and 210*d*), the conductive member 220*b* is located close to the one ends of the dipole antennas 210*c* and 210*d*.

Also, the dipole antennas 210*a* and 210*d* are arranged with their respective other ends close to each other.

Likewise, the dipole antennas 210*b* and 210*c* are arranged with their respective other ends close to each other.

Assuming that −y direction coincides with the direction toward the ground, the dipole antennas 210*b*, 210*d* transmit and receive radio waves of +45 degree polarization, and the dipole antennas 210*a*, 210*c* transmit and receive radio waves of −45 degree polarization. Accordingly, the polarization directions of the radio waves received by the dipole antennas 210*a*, 210*c* and the radio waves received by the dipole antennas 210*b*, 210*d* are different by 90 degrees.

Thus, the four dipole antennas 210*a*, 210*b*, 210*c*, and 210*d* are located on respective sides of a quadrangle. Preferably, the quadrangle is a square with the feeding point at the center of each side.

This can increase the symmetry of the antennas 200 in the horizontal and vertical directions.

In the second embodiment, the conductive member 220*b* for the antenna 200-1 also serves as the conductive member 220*a* for the antenna 200-2. This means that the number of conductive members 220 in the array antenna 15 of the second embodiment is smaller than that in the array antenna 11 of the first embodiment.

In the second embodiment, the effect of the conductive members 220 being provided for the antenna 200 transmitting and receiving low-frequency band radio waves of mutually different polarizations is considered to be the same as that in the first embodiment. Thus, detailed description of the effect will be omitted.

In the second embodiment, the antennas 200 transmitting and receiving low-frequency band radio waves are arranged at the center of the reflector 300 in the x direction and at a large distance $DH_L$ from the flat part 310, and the antennas 100 transmitting and receiving high-frequency band radio waves are arranged on both sides of the antennas 200 and at a distance $DH_H$ from the flat part 310 that is smaller than the distance $DH_L$. Accordingly, the size of the radome 12 is less affected by the size of the antennas 200.

The dipole antenna 210*a* is an example of the first antenna element, the dipole antenna 210*b* is an example of the second antenna element, the dipole antenna 210*c* is an example of the third antenna element, and the dipole antenna 210*d* is an example of the fourth antenna element. The conductive member 220*a* is an example of the first conductive member, and the conductive member 220*b* is an example of the second conductive member.

Third Embodiment

In the first and the second embodiments, the four dipole antennas 210 of the antenna 200 are arranged on respective sides of a quadrangle.

In an array antenna 16 of the third embodiment, the four dipole antennas 210 are arranged in a cross.

The other configurations are similar to those in the first embodiment. Accordingly, the below description will focus on difference between the array antenna 16 and the array antenna 11 of the first embodiment.

<Array Antenna 16>

Figure 9:
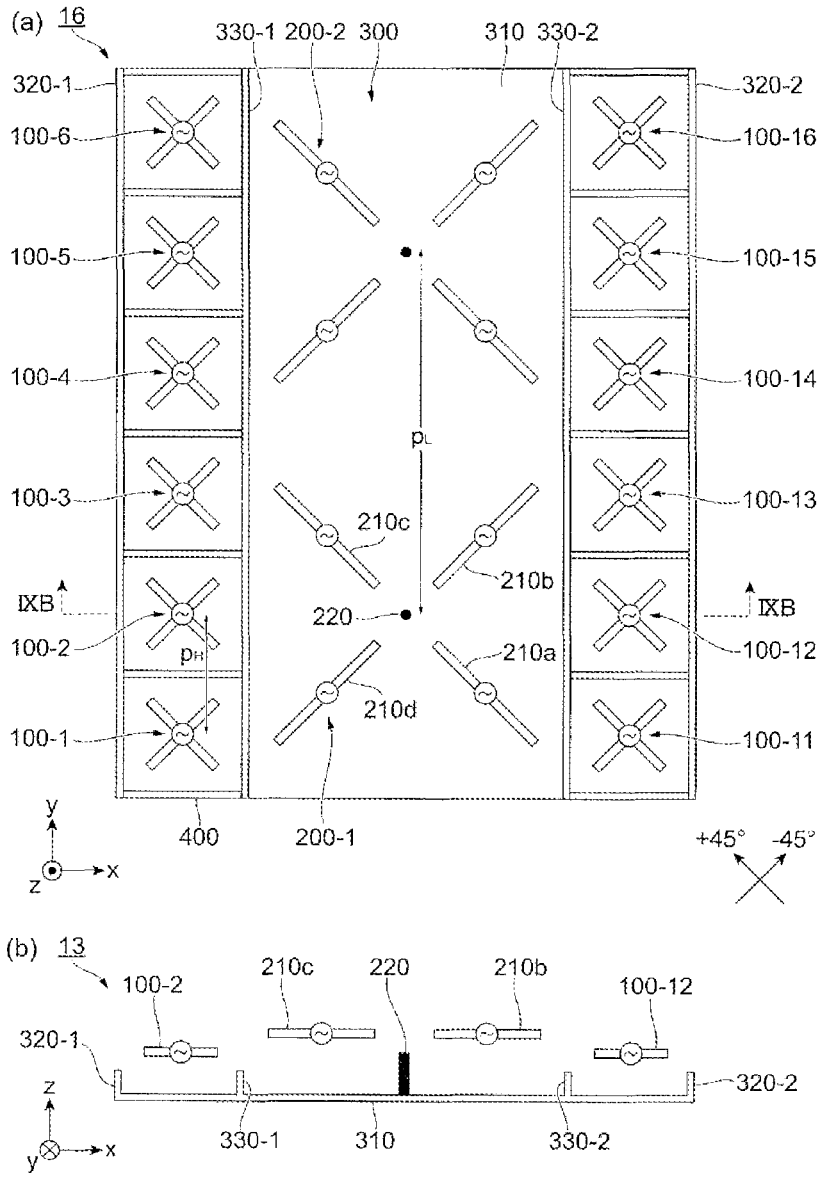
FIG. 9 shows an example of a configuration of the array antenna of the third embodiment. (a) of FIG. 9 is a front view (view of the x-y plane) of the array antenna, and (b) of FIG. 9 is a cross-sectional view (view of the x-z plane) of the array antenna taken along the line IXB-IXB in (a) of FIG. 9.

FIG. 9 shows an example of a configuration of the array antenna 16 of the third embodiment. (a) of FIG. 9 is a front view (view of the x-y plane) of the array antenna 16, and (b) of FIG. 9 is a cross-sectional view (view of the x-z plane) of the array antenna 16 taken along the line IXB-IXB in (a) of FIG. 9. Taking the sector antenna 10-1 shown in (a) of FIG. 1 as an example, the array antenna 16 will be described.

The array antenna 16 includes antennas 100-1 to 100-6 and 100-11 to 100-16 (hereinafter referred to as antennas 100 when they are not distinguished from each other) configured to transmit and receive radio waves of mutually orthogonal polarizations in the high frequency band, and antennas 200-1 and 200-2 (hereinafter referred to as antennas 200 when they are not distinguished from each other) configured to transmit and receive radio waves of mutually orthogonal polarizations in the low frequency band.

At the center of the reflector 300 in the x direction, the antennas 200-1 and 200-2 are arranged in the y direction at intervals $p_L$.

On the left side (−x direction side) of the array of the antennas 200-1 and 200-2, the antennas 100-1 to 100-6 are arranged in the y direction at intervals $p_H$.

On the right side (+x direction side) of the array of the antennas 200-1 and 200-2, the antennas 100-11 to 100-16 are arranged in the y direction at intervals $p_H$.

In this embodiment too, the interval $p_L$ in the array of the antennas 200 is three times the interval $p_H$ in the array of the antennas 100 ($p_L=3\times p_H$).

Similarly to the first embodiment, the reflector 300 includes the flat part 310, and two standing parts 320-1, 320-2 at respective ends of the reflector 300 in the ±x direction. The standing parts 320-1, 320-2 rise from the flat part 310 in the z direction and extend in the y direction. The reflector 300 further includes two standing parts 330-1, 330-2 between the center of the flat part 310 and the respective ends in the ±x direction. The standing parts 330-1, 330-2 rise from the flat part 310 in the z direction and extend in the y direction.

The antennas 200-1 and 200-2 are placed between the standing part 330-1 and the standing part 330-2.

The antennas 100-1 to 100-6 are arranged between the standing part 320-1 and the standing part 330-1, and the antennas 100-11 to 100-16 are arranged between the standing part 320-2 and the standing part 330-2.

Similarly to the first embodiment, the partition 400 is placed between each two of the antennas 100-1 to 100-6 and 100-11 to 100-16. The reference numerals for individual partitions are omitted in FIG. 9.

The antennas 100 are similar to those in the first embodiment, and thus detailed description thereof will be omitted.

Each of the antennas 200 includes four dipole antennas 210*a*, 210*b*, 210*c*, 210*d* and one conductive member 220, as depicted by the antenna 200-1. The antenna 200-1 is the same as the antenna 200-1 of the first embodiment shown in FIG. 2 when the two dipole antennas 210*a*, 210*b* and the two dipole antennas 210*c*, 210*d* of the antenna 200-1 of the first embodiment are shifted in the x direction and the −x direction, respectively. Also, both of the conductive member 220*a* and the conductive member 220*b* are shifted to constitute one conductive member 220.

In other words, the dipole antennas 210*a*, 210*b*, 210*c*, and 210*d* are arranged with their respective one ends close to each other. Near the point of intersection where the dipole antennas 210*a*, 210*b*, 210*c*, and 210*d* meet when extended (i.e. the point of intersection of four virtual lines respectively extended along the dipole antennas 210*a*, 210*b*, 210*c*, and 210*d*), the conductive member 220 is located close to the one ends of the dipole antennas 210*a*, 210*b*, 210*c*, and 210*d*.

Arranging the four dipole antennas 210 in a cross with their respective one ends close to each other can increase the symmetry of the dipole antennas 210. This can improve the symmetry of the directivity in the x direction (horizontal direction) and the y direction (vertical direction).

In the third embodiment, the effect of the conductive member 220 being provided for the antenna 200 transmitting and receiving low-frequency band radio waves of mutually different polarizations is considered to be the same as that in the first embodiment. Thus, detailed description of the effect will be omitted.

In the third embodiment, similarly to the second embodiment, the antennas 200 transmitting and receiving low-frequency band radio waves are arranged at the center of the reflector 300 in the x direction and at a large distance $DH_L$ from the flat part 310, and the antennas 100 transmitting and receiving high-frequency band radio waves are arranged on both sides of the antennas 200 and at a distance $DH_H$ from the flat part 310 that is smaller than the distance $DH_L$. Accordingly, the size of the radome 12 is less affected by the size of the antennas 200.

The dipole antenna 210*a* is an example of the first antenna element, the dipole antenna 210*b* is an example of the second antenna element, the dipole antenna 210*c* is an example of the third antenna element, and the dipole antenna 210*d* is an example of the fourth antenna element. The conductive member 220 is an example of the conductive member.

In the present specification, the array antenna 11, 15, and 16 have been described as a dual-frequency antenna; however, they may only have the antennas 200 for the low frequency band. In this case, the frequency $f_{0L}$ (wavelength $\lambda_{0L}$) designed in the low frequency band may be the frequency $f_0$ (wavelength $\lambda_0$) to be designed.

In the present specification, the antennas 200 have been described as dual polarization antennas for transmitting and receiving ±45 degree polarized waves; however, the polarization direction is not limited to this and the antennas 200 may be dual polarization antennas for transmitting and receiving vertically polarized waves and horizontally polarized waves.

The invention claimed is:

1. An antenna comprising:

a reflective member including a flat part;

a first antenna element disposed on the flat part of the reflective member, the first antenna element being configured to transmit and receive radio waves of a first polarization;

a second antenna element disposed on the flat part of the reflective member, one end of the second antenna element being located close to one end of the first antenna element, the second antenna element being configured to transmit and receive radio waves of a second polarization different from the first polarization;

a conductive member disposed close to the one ends of the first antenna element and the second antenna element and near a point of intersection where the first antenna element and the second antenna element meet when extended;

a third antenna element disposed on the flat part of the reflective member, the third antenna element being configured to transmit and receive radio waves of the first polarization;

a fourth antenna element disposed on the flat part of the reflective member, one end of the fourth antenna element being located close to one end of the third antenna element, the fourth antenna element being configured to transmit and receive radio waves of the second polarization; and another conductive member disposed close to the one ends of the third antenna element and the fourth antenna element and near a point of intersection where the third antenna element and the fourth antenna element meet when extended, wherein the other end of the fourth antenna element is located close to the other end of the first antenna element, and the other end of the third antenna element is located close to the other end of the second antenna element, wherein each of the first antenna element, the second antenna element, the third antenna element and the fourth antenna element is a dipole antenna comprising:

two radiation parts;

a support part extending to the flat part of the reflective member, the support part being configured to support the two radiation parts; and a base configured to hold the support part relative to the flat part of the reflective member, wherein each of the two radiation parts includes a first portion, a second portion, and a third portion, the first portion being parallel to the flat part of the reflective member, the second portion changing distance from the flat part as the second portion goes away from the support part, the third portion bending and extending from a distal end of the second portion;

wherein each of the conductive member and the another conductive member is a rod-like or plate-like member rising from the flat part of the reflective member, and each of the conductive member and the another conductive member is directly connected to the reflective member at one position.

2. An antenna comprising:

a reflective member including a flat part;

a first antenna element disposed on the flat part of the reflective member, the first antenna element being configured to transmit and receive radio waves of a first polarization;

a second antenna element disposed on the flat part of the reflective member, one end of the second antenna element being located close to one end of the first antenna element, the second antenna element being configured to transmit and receive radio waves of a second polarization different from the first polarization; and a conductive member disposed close to the one ends of the first antenna element and the second antenna element and near a point of intersection where the first antenna element and the second antenna element meet when extended, wherein each of the first antenna element and the second antenna element is a dipole antenna comprising:

two radiation parts;

a support part extending to the flat part of the reflective member, the support part being configured to support the two radiation parts; and a base configured to hold the support part relative to the flat part of the reflective member, wherein each of the two radiation parts includes a first portion, a second portion, and a third portion, the first portion being parallel to the flat part of the reflective member, the second portion changing distance from the flat part as the second portion goes away from the support part, the third portion bending and extending from a distal end of the second portion;

wherein the conductive member is a rod-like or plate-like member rising from the flat part of the reflective member, and the conductive member is directly connected to the reflective member at one point.

3. An array antenna comprising:

a reflective member including a flat part;

a plurality of first antennas arranged on the flat part of the reflective member, each of the plurality of first antennas including a first antenna element, a second antenna element, a third antenna element, a fourth antenna element, a first conductive member, and a second conductive member, the first antenna element being configured to transmit and receive radio waves of a first polarization in a first frequency band, the second antenna element being configured to transmit and receive radio waves of a second polarization in the first frequency band different from the first polarization in the first frequency band, one end of the second antenna element being located close to one end of the first antenna element, the third antenna element being configured to transmit and receive radio waves of the first polarization in the first frequency band, the fourth antenna element being configured to transmit and receive radio waves of the second polarization in the first frequency band, one end of the fourth antenna element being located close to one end of the third antenna element, the first conductive member being disposed close to the one ends of the first antenna element and the second antenna element and near a point of intersection where the first antenna element and the second antenna element meet when extended, the second conductive member being disposed close to the one ends of the third antenna element and the fourth antenna element and near a point of intersection where the third antenna element and the fourth antenna element meet when extended, the other end of the first antenna element being located close to the other end of the fourth antenna element, the other end of the second antenna element being located close to the other end of the third antenna element; and a plurality of second antennas arranged on the flat part of the reflective member along an array of the plurality of first antennas, each of the plurality of second antennas being configured to transmit and receive radio waves in a second frequency band higher than the first frequency band, wherein each of the first antenna element, the second antenna element, the third antenna element, and the fourth antenna element included in each of the plurality of first antennas is a dipole antenna comprising:

two radiation parts;

a support part extending to the flat part of the reflective member, the support part being configured to support the two radiation parts; and a base configured to hold the support part relative to the flat part of the reflective member, wherein each of the two radiation parts includes a first portion, a second portion, and a third portion, the first portion being parallel to the flat part of the reflective member, the second portion changing distance from the flat part as the second portion goes away from the support part, the third portion bending and extending from a distal end of the second portion.

4. The array antenna according to claim 3, wherein an array of the plurality of second antennas is arranged on the flat part of the reflective member such that the array of the plurality of second antennas overlaps the array of the plurality of first antennas.

5. The array antenna according to claim 3, wherein an interval in the array of the plurality of first antennas is three times an interval in the array of the plurality of second antennas.

6. The array antenna according to claim 3, wherein two of the plurality of second antennas are disposed in an area surrounded by the first antenna element, the second antenna element, the third antenna element, and the fourth antenna element of each of the plurality of first antennas.

7. The array antenna according to claim 3, wherein radio waves transmitted and received by the plurality of first antennas include radio waves of +45 degree polarization and −45 degree polarization relative to an array of the plurality of first antennas.

8. An array antenna comprising:

a reflective member including a flat part;

a plurality of first antennas arranged on the flat part of the reflective member, each of the plurality of first antennas including a first antenna element, a second antenna element, a third antenna element, a fourth antenna element, and a conductive member, the first antenna element being configured to transmit and receive radio waves of first polarization in a first frequency band, the second antenna element being configured to transmit and receive radio waves of second polarization in the first frequency band different from the first polarization, one end of the second antenna element being located close to one end of the first antenna element, the third antenna element being configured to transmit and receive radio waves of the first polarization in the first frequency band, one end of the third antenna element being located close to the one end of the first antenna element, the fourth antenna element being configured to transmit and receive radio waves of the second polarization in the first frequency band, one end of the fourth antenna element being located close to the one end of the first antenna element, the conductive member being disposed close to the one ends of the first antenna element, the second antenna element, the third antenna element, and the fourth antenna element and near a point of intersection where the first antenna element, the second antenna element, the third antenna element, and the fourth antenna element meet when extended; and a plurality of second antennas arranged on the flat part of the reflective member along an array of the plurality of first antennas, each of the plurality of second antennas being configured to transmit and receive radio waves in a second frequency band higher than the first frequency band, wherein each of the first antenna element, the second antenna element, the third antenna element, and the fourth antenna element included in each of the plurality of first antennas is a dipole antenna comprising:

two radiation parts;

a support part extending to the flat part of the reflective member, the support part being configured to support the two radiation parts; and a base configured to hold the support part relative to the flat part of the reflective member, wherein each of the two radiation parts includes a first portion, a second portion, and a third portion, the first portion being parallel to the flat part of the reflective member, the second portion changing distance from the flat part as the second portion goes away from the support part, the third portion bending and extending from a distal end of the second portion.

9. A sector antenna comprising:

an array antenna including a plurality of antennas arranged on a flat part of a reflective member, each of the plurality of antennas including a first antenna element, a second antenna element, and a conductive member, the first antenna element being configured to transmit and receive radio waves of a first polarization, the second antenna element being configured to transmit and receive radio waves of a second polarization different from the first polarization, one end of the second antenna element being located close to one end of the first antenna element, the conductive member being disposed close to the one ends of the first antenna element and the second antenna element and near a point of intersection where the first antenna element and the second antenna element meet when extended; and a cover configured to cover the array antenna, wherein each of the first antenna element and the second antenna element is a dipole antenna comprising:

two radiation parts;

a support part extending to the flat part of the reflective member, the support part being configured to support the two radiation parts; and a base configured to hold the support part relative to the flat part of the reflective member, wherein each of the two radiation parts includes a first portion, a second portion, and a third portion, the first portion being parallel to the flat part of the reflective member, the second portion changing distance from the flat part as the second portion goes away from the support part, the third portion bending and extending from a distal end of the second portion.

10. A dipole antenna comprising:

two radiation parts;

a support part extending to a flat part of a reflective member to which the support part is attached, the support part being configured to support the two radiation parts; and a base configured to hold the support part relative to the flat part of the reflective member, wherein each of the two radiation parts includes a first portion, a second portion, and a third portion, the first portion being parallel to the flat part of the reflective member, the second portion changing distance from the flat part as the second portion goes away from the support part, the third portion bending and extending from a distal end of the second portion;

wherein the dipole antenna further comprises: a spacer made of a dielectric and interposed between the base and the flat part of the reflective member, wherein the spacer includes a base holding member configured to hold the base.

11. A dipole antenna comprising:

two radiation parts;

a support part extending to a flat part of a reflective member to which the support part is attached, the support part being configured to support the two radiation parts; and a base configured to hold the support part relative to the flat part of the reflective member, wherein each of the two radiation parts includes a first portion, a second portion, and a third portion, the first portion being parallel to the flat part of the reflective member, the second portion changing distance from the flat part as the second portion goes away from the support part, the third portion bending and extending from a distal end of the second portion;

wherein the dipole antenna further comprises: a spacer made of a dielectric and interposed between the base and the flat part of the reflective member, wherein the spacer includes a spacer holding member configured to allow the spacer to be held on the reflective member.

* * * * *